US009280117B2

(12) United States Patent
Nakajima et al.

(10) Patent No.: US 9,280,117 B2
(45) Date of Patent: Mar. 8, 2016

(54) IMAGE FORMING APPARATUS FOR PERFORMING A DOCUMENT READING OPERATION AND A PRINTING OPERATION IN PARALLEL

(71) Applicant: CANON KABUSHIKI KAISHA, Tokyo (JP)

(72) Inventors: Yuki Nakajima, Numazu (JP); Masaru Aoki, Numazu (JP); Hiroto Endo, Hadano (JP)

(73) Assignee: Canon Kabushiki Kaisha, Tokyo (JP)

( * ) Notice: Subject to any disclaimer, the term of this patent is extended or adjusted under 35 U.S.C. 154(b) by 107 days.

(21) Appl. No.: 14/028,807

(22) Filed: Sep. 17, 2013

(65) Prior Publication Data

US 2014/0079456 A1 Mar. 20, 2014

(30) Foreign Application Priority Data

Sep. 19, 2012 (JP) ..... 2012-205854

(51) Int. Cl.

| | |
|---|---|
| ***B41J 29/38*** | (2006.01) |
| ***G03G 21/00*** | (2006.01) |
| ***B65H 15/00*** | (2006.01) |
| ***G03G 15/00*** | (2006.01) |

(52) U.S. Cl.

CPC ..... *G03G 15/607* (2013.01); *G03G 15/6529* (2013.01); *G03G 2215/00599* (2013.01); *G03G 2215/00928* (2013.01)

(58) Field of Classification Search

CPC ..... G03G 2215/00928

See application file for complete search history.

(56) References Cited

U.S. PATENT DOCUMENTS

| | | | | |
|---|---|---|---|---|
| 5,712,676 | A | 1/1998 | Takaki | |
| 2011/0024965 | A1 * | 2/2011 | Tokoro | 271/3.14 |
| 2011/0248439 | A1 * | 10/2011 | Oshima | 271/3.16 |

FOREIGN PATENT DOCUMENTS

| | | | | |
|---|---|---|---|---|
| JP | 2000-185881 A | | 7/2000 | |
| JP | 2000185881 A | * | 7/2000 | B65H 85/00 |
| JP | 2006-232467 A | | 9/2006 | |

* cited by examiner

*Primary Examiner* — Jill Culler
*Assistant Examiner* — Ruben Parco, Jr.
(74) *Attorney, Agent, or Firm* — Canon USA, Inc., IP Division

(57) ABSTRACT

When images of a plurality of document sheets are to be read and formed on a plurality of recording materials, an image forming apparatus performs control to convey a document sheet and a recording material at one of a recording material conveyance speed and a document conveyance speed, whichever is lower.

12 Claims, 21 Drawing Sheets

ORDER OF CONVEYANCE OF DOCUMENT SHEETS AND RECORDING MATERIALS TO COMMON CONVEYANCE PATH 80 IN PROCESS OF TWO-SIDED FEEDING-READING OF N DOCUMENT SHEETS AND TWO-SIDED PRINTING ON N RECORDING MATERIALS

ORDER OF CONVEYANCE OF DOCUMENT SHEETS AND RECORDING MATERIALS TO COMMON CONVEYANCE PATH 80 IN PROCESS OF TWO-SIDED FEEDING-READING OF N DOCUMENT SHEETS AND TWO-SIDED PRINTING ON N RECORDING MATERIALS

IMAGE FORMING APPARATUS FOR PERFORMING A DOCUMENT READING OPERATION AND A PRINTING OPERATION IN PARALLEL

BACKGROUND OF THE INVENTION

1. Field of the Invention

The present invention relates to an image forming apparatus, which is typified by a copying machine and a laser beam printer, provided with a document reading apparatus, which is typified by an automatic document feeder (ADF) unit.

2. Description of the Related Art

With a conventional image forming apparatus of this type, a document conveyance path for conveying a document to a document reading unit, and a recording material conveyance path for conveying a recording material to an image forming unit are configured independently of each other. Specifically, a sheet feed unit, guide members, which form a predetermined conveyance path, a plurality of conveyance rollers, a motor for driving the conveyance rollers, and a sheet discharge unit are disposed separately for each of a document and a recording material.

For that reason, image forming apparatuses have been with unavoidable problems of the increase in complexity of the overall mechanical configuration, the increase in production cost, and the increase in size. To solve those problems, for example, Japanese Patent Application Laid-Open No. 2000-185881 discusses a technique for simplifying the configuration and reducing production cost and size by using a document conveyance path and a recording material conveyance path as a common conveyance path. A document reading unit is disposed in the recording material conveyance path ranging from a sheet feed unit to a sheet discharge unit.

However, in an image forming apparatus discussed in Japanese Patent Application Laid-Open No. 2000-185881, the document reading unit is disposed in the recording material conveyance path, for example, between a fixing device and the sheet discharge unit. Therefore, there has been a problem that, during a document reading operation during which a document exists in the recording material conveyance path, a printing operation for a recording material is suspended, resulting in degraded productivity of the image forming apparatus.

Further, in a case where a plurality of document sheets is read and printing is made on a plurality of recording materials with the configuration discussed in Japanese Patent Application Laid-Open No. 2000-185881, alternately performing the document reading operation and the printing operation will degrade the productivity of recording material printing because of the above-described reason. To avoid that problem, the document reading operation may be performed for all of document sheets prior to the printing operation for recording materials. In this case, however, a mass image memory is required to store all of image data after the document reading operation, resulting in a production cost increase.

SUMMARY OF THE INVENTION

The present invention is directed to an image forming apparatus capable of preventing degradation of the productivity in a case where a document reading operation and a printing operation are performed in parallel.

According to an aspect of the present invention, an image forming apparatus includes a first conveyance path configured to convey a recording material at a first conveyance speed to form an image on the recording material, an image forming unit configured to form an image on the recording material being conveyed in the first conveyance path, a second conveyance path configured to reverse the recording material having the image formed thereon by the image forming unit and to convey the recording material to the image forming unit again, a reading unit configured to read an image of a first surface of a document sheet being conveyed at a second conveyance speed in the second conveyance path, a third conveyance path configured to convey the document sheet to read an image of a second surface of the document sheet, and a control unit configured to, when images of a plurality of document sheets are to be read and formed an image on a plurality of recording materials, perform control to convey each document sheet and each recording material at one of the first conveyance speed and the second conveyance speed, whichever is lower.

Further features of the present invention will become apparent from the following description of exemplary embodiments with reference to the attached drawings.

DESCRIPTION OF THE EMBODIMENTS

Image Forming Process in Image Forming Apparatus

Figure 1A:
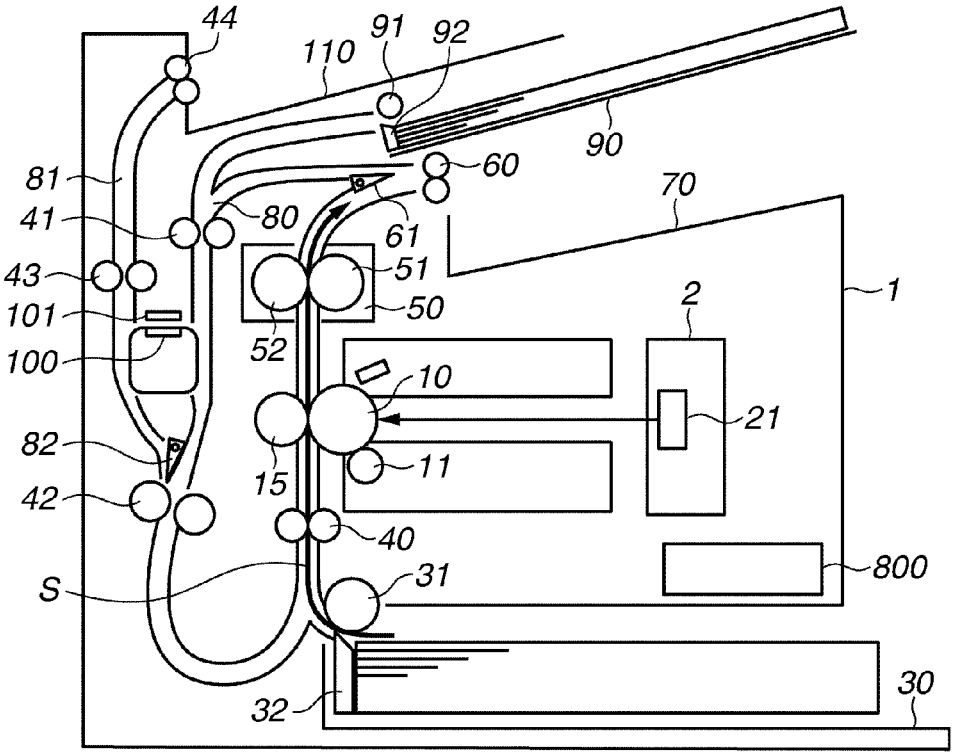
FIGS. 1A and 1B are cross sectional views illustrating a configuration and a two-sided printing process of an image forming apparatus according to a first exemplary embodiment.

A first exemplary embodiment will be described below. First of all, an image forming process will be described below. FIG. 1A is a cross sectional view illustrating an image forming apparatus 1 according to the first exemplary embodiment. Referring to FIG. 1A, the image forming apparatus 1 includes a rotatable photosensitive drum 10 as an image bearing member, and a developing roller 11 rotating while holding toner and in contact with the photosensitive drum 10. The photosensitive drum 10 and the developing roller 11 are disposed at the center of the image forming apparatus 1. Upon reception of an image forming instruction, a light emitting unit 21 included in an optical unit 2 irradiates the surface of the rotating photosensitive drum 10 with a laser beam. A charge-based latent image is formed on the surface of the photosensitive drum 10 which has been irradiated with a laser beam. When the developing roller 11 applies the toner held therein to the latent image formed on the surface of the photosensitive drum 10, development is performed and a toner image is formed on the surface of the photosensitive drum 10.

A plurality of recording materials S is stored in a first sheet feed unit 30. The plurality of recording materials S is to be conveyed in a conveyance path for image formation (first conveyance path), configured between a conveyance roller pair 40 and a discharge roller pair 60, and then subjected to image formation. Upon reception of an image forming instruction, the plurality of recording materials S is conveyed one by one to the conveyance roller pair 40 by a cassette (hereinafter, referred to as CST) pickup roller 31 and a separation member 32. The conveyance roller pair 40 conveys a recording material S to a transfer portion 15 while the conveyance roller pair 40 adjusts the conveyance timing so that the toner image on the photosensitive drum 10 is to be transferred onto a predetermined position on the recording material S.

The toner image on the photosensitive drum 10 is transferred onto the recording material S by a transfer voltage and pressure applied to the transfer portion 15. Then, the recording material S is conveyed to a fixing unit 50. The fixing unit 50 applies heat and pressure to the toner image on the recording material S to fix the toner image thereon. In that case, heat is generated by a heating roller 51, and pressure is generated by a pressure roller 52 facing the heating roller 51. After the toner image has been fixed onto the recording material S, the recording material S is conveyed to the discharge roller pair 60.

Figure 1B:
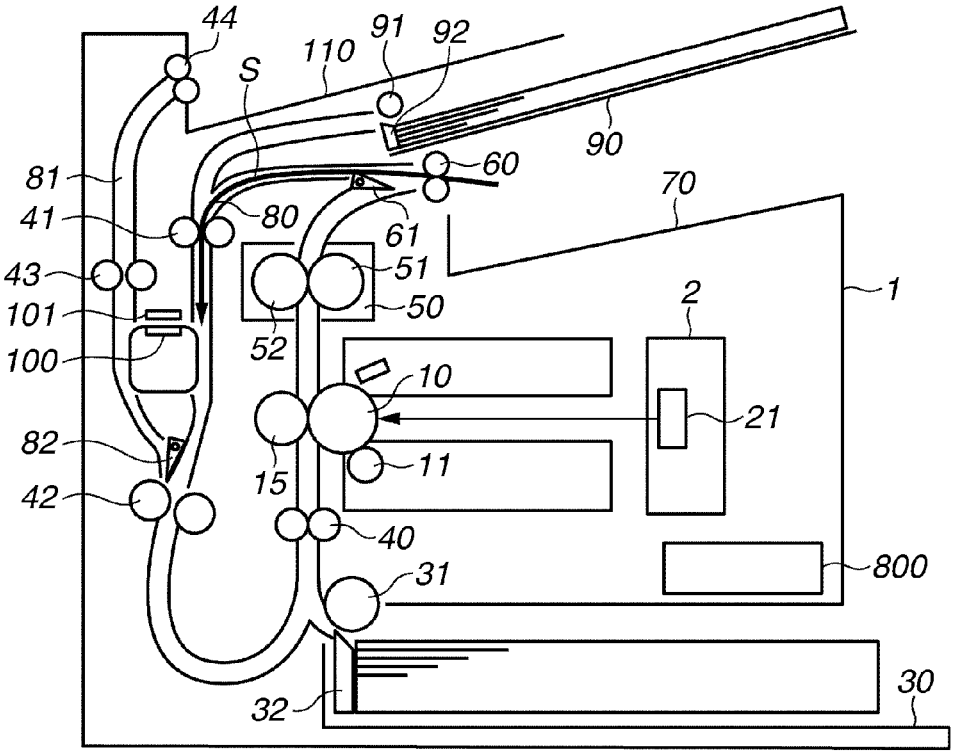

In the case of one-sided printing, the discharge roller pair 60 conveys the recording material S to the outside of the image forming apparatus 1, and the recording material S is stacked onto a first discharge unit 70. In the case of two-sided printing, the discharge roller pair 60 conveys the recording material S until the trailing edge of the recording material S in the conveyance direction (hereinafter, simply referred to as "trailing edge") passes a two-sided flapper 61. Then, upon detection that the recording material S has passed the two-sided flapper 61, the two-sided flapper 61 changes the conveyance destination of the recording material S to the side of a common conveyance path 80 (second conveyance path), to which both the recording material S and a document sheet G are conveyed. The discharge roller pair 60 rotates in the reverse direction to convey the recording material S to the common conveyance path 80. As illustrated in FIG. 1B, the recording material S which has been conveyed on a switchback basis is conveyed to a document reading unit 100 by a conveyance roller pair 41. Further, the recording material S is conveyed again to the transfer portion 15 by conveyance roller pairs 42 and 40. At the transfer portion 15, a toner image is transferred onto the other side of the recording material S. The fixing unit 50 fixes the toner image onto the recording material S. Then, the discharge roller pair 60 stacks the recording material S onto the first discharge unit 70.

Figure 2A:
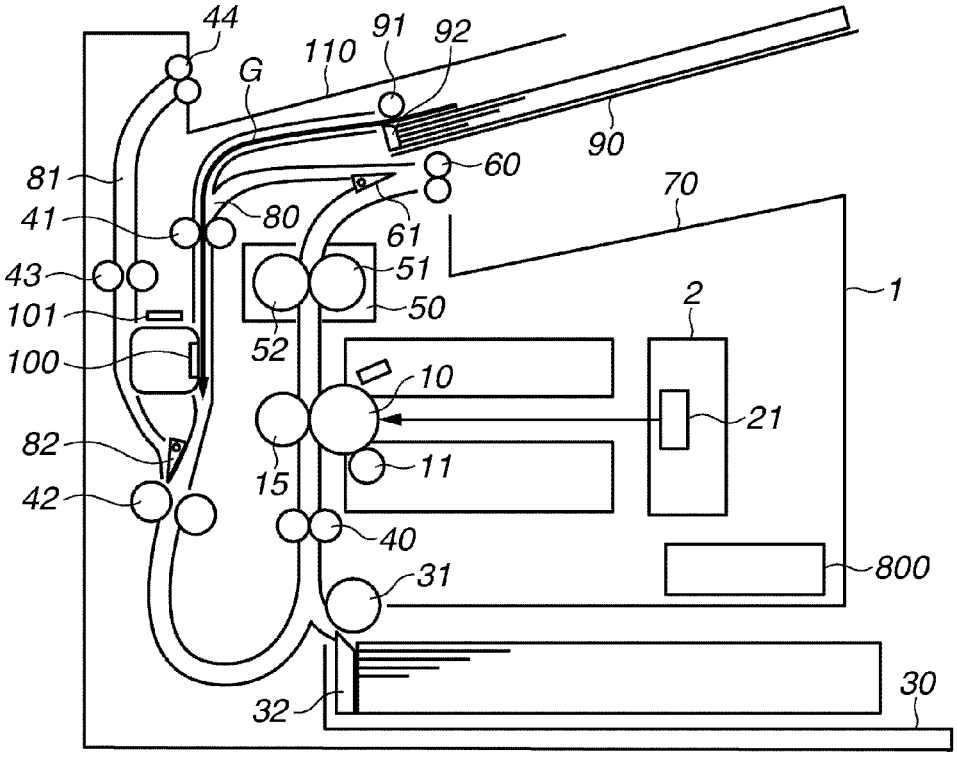
FIGS. 2A and 2B illustrate operations of two-sided feeding-reading of a document sheet and two-sided printing on a recording material according to the first exemplary embodiment.

Operations of Two-Sided Feeding-Reading of Document Sheet and Two-Sided Printing on Recording Material The following describes a process of reading an image of a document image and making two-sided printing on a recording material. FIG. 2A illustrates a state where reading of the front side of the document sheet G is started. A plurality of document sheets G stored in a second sheet feed unit 90 disposed on the upstream side of the common conveyance path 80 in the conveyance direction is conveyed one by one to the conveyance roller pair 41 by a document pickup roller 91 and a separation member 92. Before the document reading unit 100 starts reading the first side (front side) of the document sheet G conveyed from the second sheet feed unit 90, the document reading unit 100 emits light to a white reference member 101, corrects a white reference value, and then rotates to face the common conveyance path 80. The conveyance roller pair 41 conveys the document sheet G to the document reading unit 100. Upon detection of the leading edge of the document sheet G in the conveyance direction (hereinafter, simply referred to as "leading edge"), the document reading unit 100 reads an image on the document sheet G. The image read by the document reading unit 100 is stored in an image memory 804 (described below) as document image data for the first side of the document sheet G. Referring to FIG. 2A, the white reference member 101 is disposed downward in consideration of dust adherence. Although a white reference plate is used as a reference member, the color of the reference member is not limited to white.

Figure 2B:
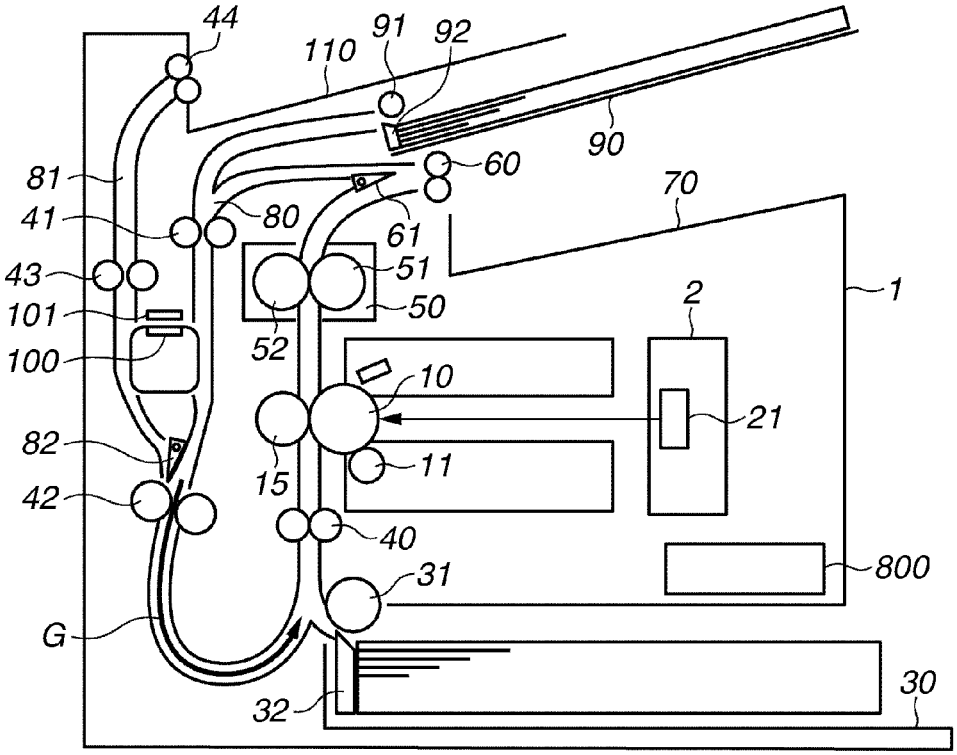

FIG. 2B illustrates a state where reading of the first side (front side) of the document sheet G has been completed. After the document sheet G passes the document reading unit 100, the document sheet G is conveyed to the conveyance roller pair 42. Upon detection that the trailing edge of the document sheet G has passed a switchback flapper 82, the conveyance roller pair 42 stops. Accordingly, the document sheet G stops being pinched by the conveyance roller pair 42.

Figure 2C:
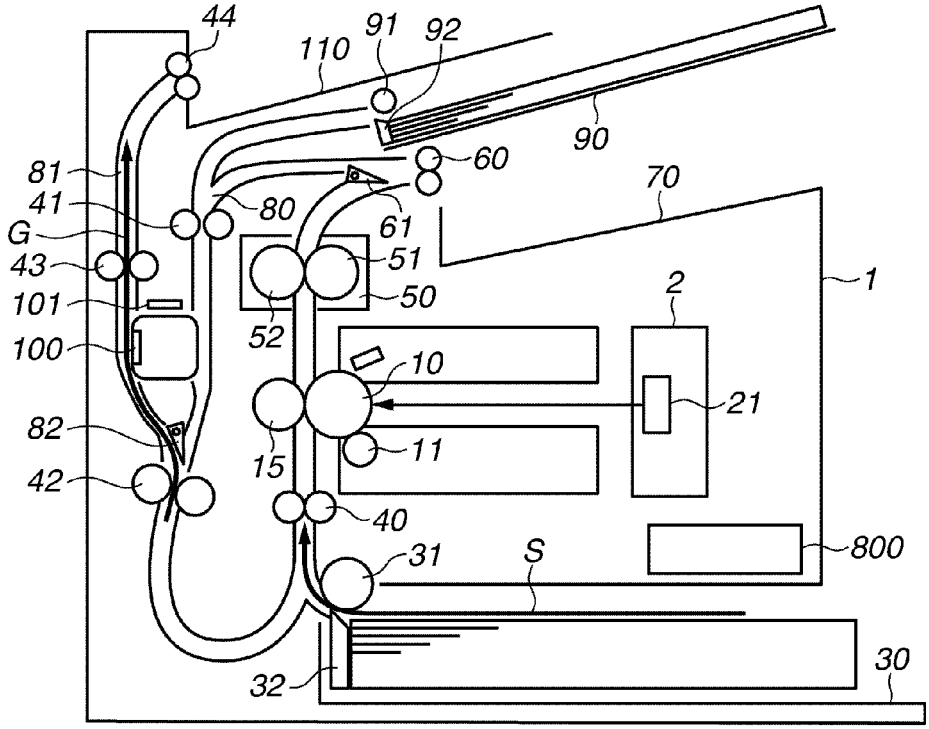
FIGS. 2C and 2D illustrate the operations of two-sided feeding-reading of a document sheet and two-sided printing on a recording material according to the first exemplary embodiment.

FIG. 2C illustrates a state where the document reading unit 100 starts reading the second side (back side) of the document sheet G. When the switchback flapper 82 changes the conveyance path of the document sheet G from the common conveyance path 80 to a document conveyance path (third conveyance path), the document reading unit 100 rotates to face the document conveyance path 81. Then, the conveyance roller pair 42 starts rotating in the reverse direction. The document sheet G is conveyed along the document conveyance path 81 in the direction opposite the document reading unit 100. Upon detection of the leading edge of the document sheet G, the document reading unit 100 reads an image of the second side (back side) of the document sheet G, and the read image is stored in the image memory 804 as document image data for the second side of the document sheet G. When the back side of the document sheet G is not to be read, the document sheet G is conveyed in the document conveyance path 81 by conveyance roller pairs 43 and 44, and then stacked onto a second discharge unit 110.

The plurality of recording materials S fed from the first sheet feed unit 30 is conveyed one by one to the conveyance roller pair 40. When the light emitting unit 21 irradiates the photosensitive drum 10 with a laser beam, a latent image based on the document image data for the second side (back side) of the document sheet G stored in the image memory 804 is formed on the photosensitive drum 10. Then, when the toner image formed by developing the latent image is transferred onto the recording material S at the transfer portion 15, the recording material S is conveyed to the fixing unit 50, and image formation for the second side of the document sheet G has been completed. Referring to FIG. 2C, feeding of the recording material S is started at the same time when reading of the image on the second side (back side) of the document sheet G is started. However, the feeding of the recording material S may be started after the reading of the image on the second side of the document sheet G has been completed.

Figure 2D:
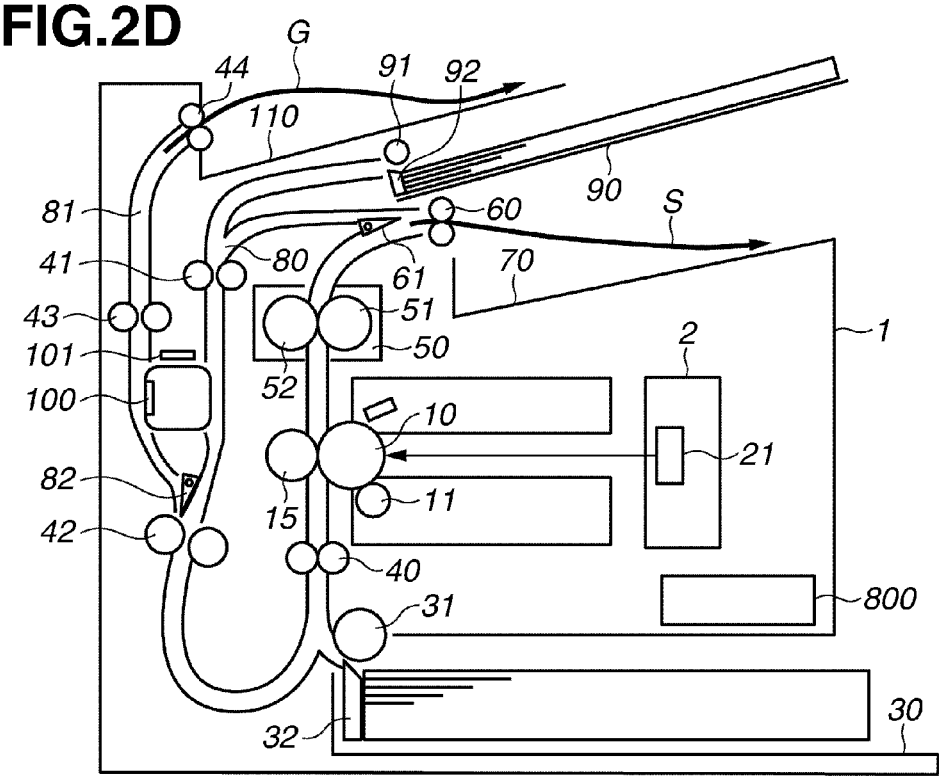

FIG. 2D illustrates a state where reading of the back side of the document sheet G has been completed. Upon completion of reading of the document sheet G, the document sheet G is conveyed by the conveyance roller pairs 43 and 44, and then stacked onto the second discharge unit 110. When the trailing edge of the document sheet G has passed the switchback flapper 82, the switchback flapper 82 changes the conveyance path of the recording material S from the document conveyance path 81 to the common conveyance path 80 so that the recording material S being conveyed in the common conveyance path 80 is conveyed toward the conveyance roller pair 40. Then, the discharge roller pair 60 disposed on the downstream side of the recording material S in the conveyance direction rotates in the reverse direction. The recording material S that has completed image formation for the second side of the document sheet G is conveyed to the common conveyance path 80 switched by the two-sided flapper 61.

Figure 2E:
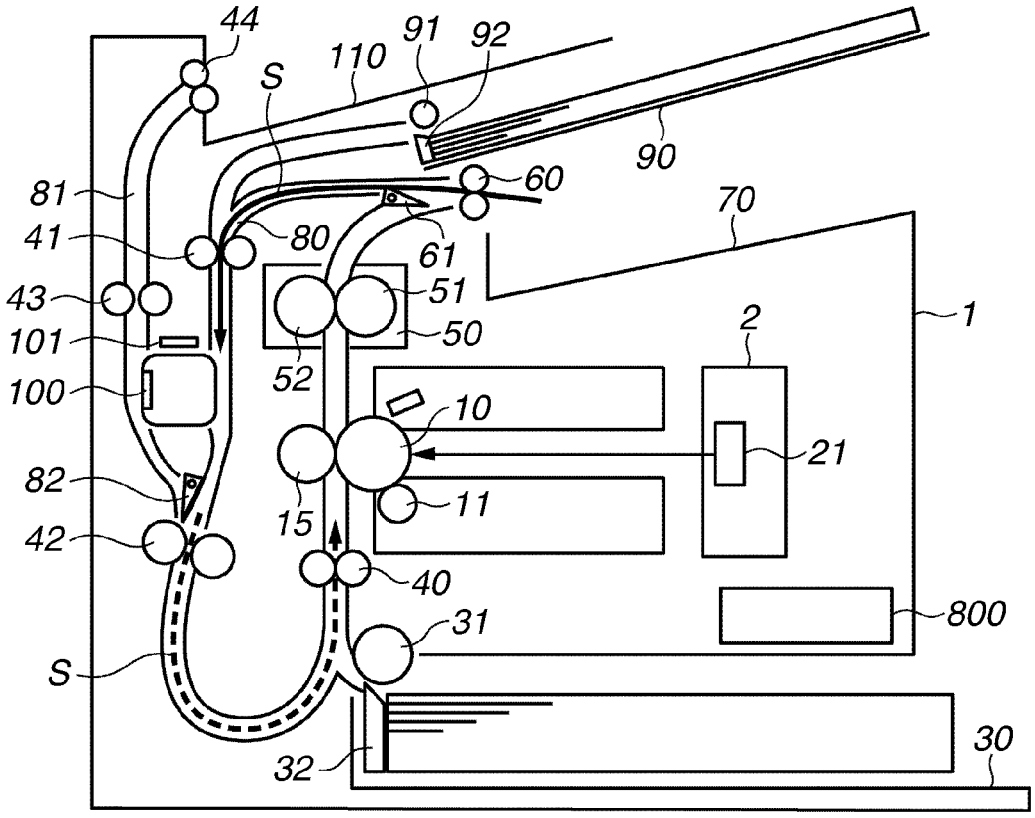
FIG. 2E illustrates the operations of two-sided feeding-reading of a document sheet and two-sided printing on a recording material according to the first exemplary embodiment.

FIG. 2E illustrates a state where the recording material S is being conveyed to an image forming unit to be subjected to image formation for the first side of the document sheet G. The common conveyance path 80 is a two-sided conveyance path for image formation on the second side of the recording material S that has completed image formation on the first side. The recording material S conveyed to the common conveyance path 80 passes the document reading unit 100, in which a sensor faces the side of the document conveyance path 81, and then is conveyed to the conveyance roller pair 42. Then, the recording material S is conveyed again to the transfer portion 15 by the conveyance roller pairs 40 and 42, as indicated by the broken line. A toner image based on the document image data for the first side of the document sheet G stored in the image memory 804 is formed on the recording material S that has completed image formation for the second side of the document sheet G. The recording material S is stacked onto the first discharge unit 70.

Overview of Control Unit of Image Forming Apparatus

Figure 3:
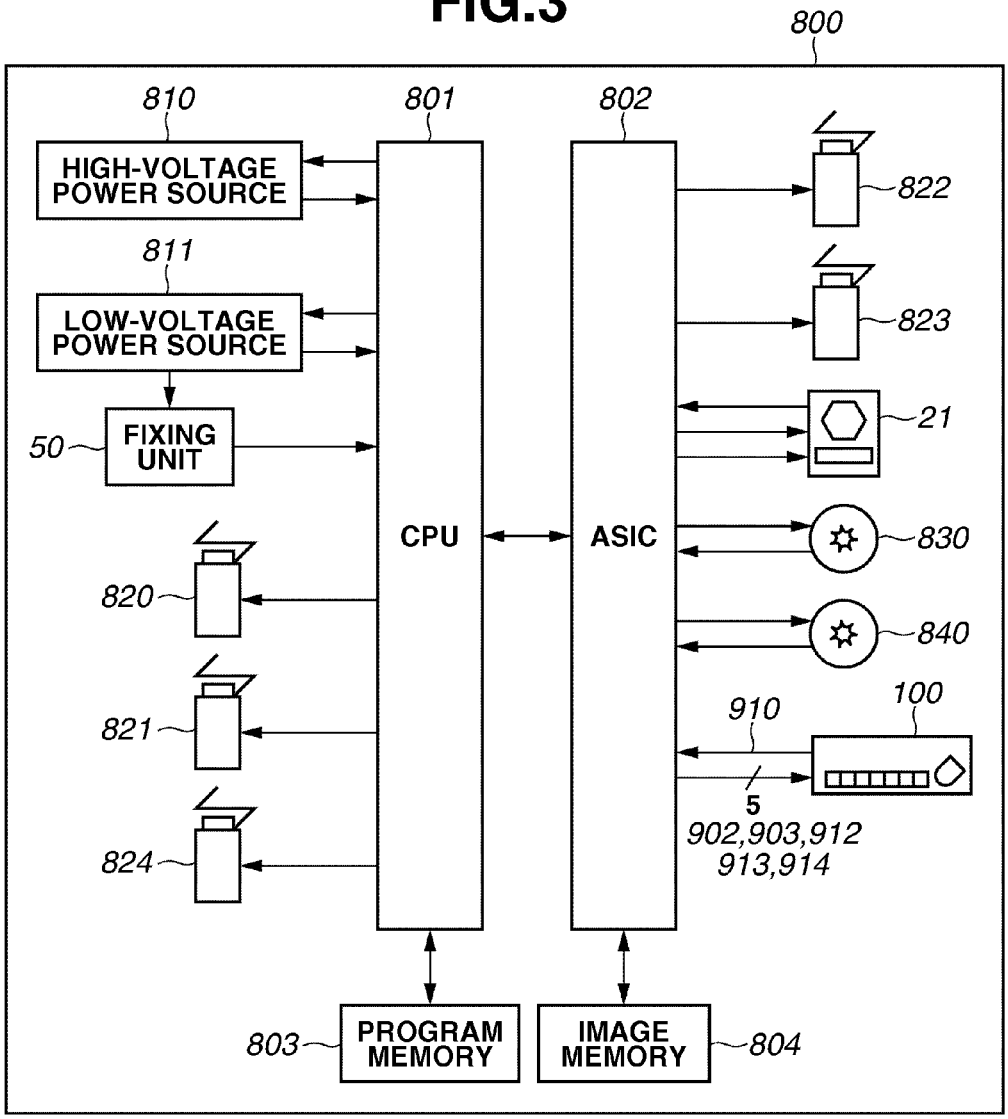
FIG. 3 is a block diagram illustrating a configuration of a control unit according to the first and a second exemplary embodiments.

FIG. 3 is a block diagram illustrating a configuration of a control unit 800 including a CPU 801, which controls the image forming apparatus 1. Referring to FIG. 3, the light emitting unit 21 including a rotational polygon mirror, a motor, and a laser light emitting element is connected to an application specific integrated circuit (ASIC) 802. To irradiate the photosensitive drum 10 with a laser beam to form a desired latent image, the CPU 801 outputs a plurality of control signals to the ASIC 802 to control the light emitting unit 21 included in the optical unit 2. A main motor 830 drives the CST pickup roller 31, the conveyance roller pair 40, the photosensitive drum 10, the transfer portion 15, the heating roller 51, the pressure roller 52, and the discharge roller pair 60 to convey the recording material S. A two-sided drive motor 840 drives the document pickup roller 91 and the conveyance roller pairs 41 to 44. A discharge roller reversing solenoid 824 changes the rotational direction of the discharge roller pair 60. When feeding rollers for feeding the recording material S are started being driven, a CST feeding solenoid 822 is turned ON to drive the CST pickup roller 31. The CPU 801 controls a drive system, such as the main motor 830 and the two-sided drive motor 840, via the ASIC 802.

The CPU 801 controls a high-voltage power source 810 for controlling a charging voltage, a development voltage, and a transfer voltage required for the electrophotographic process, a low-voltage power source 811, and the fixing unit 50. The CPU 801 further detects the temperature by using a thermistor (not illustrated) provided in the fixing unit 50, and performs control to maintain the temperature of the fixing unit 50 constant.

A program memory 803 is connected to the CPU 801 via a bus (not illustrated). The program memory 803 stores programs and data used by the CPU 801 to perform processing. The CPU 801 controls operations of the image forming apparatus 1 based on the programs and the data stored in the program memory 803.

The ASIC 802 performs speed control for the motor in the light emitting unit 21, and speed control for the main motor 830 and the two-sided drive motor 840 based on instructions from the CPU 801. In motor speed control, the ASIC 802 detects a tach (tachometer) signal (a pulse signal output from each motor each time the motor rotates), and outputs an acceleration or deceleration signal to each motor so that the tach signal is output at predetermined intervals. Performing motor control via hardware circuitry, such as the ASIC 802, in this way enables reduction of control load on the CPU 801.

The following describes control operations performed by the control unit 800 at the time of printing on a recording material. Upon reception of a print command for instructing printing on a recording material from a host computer (not illustrated), the CPU 801 drives the main motor 830, the two-sided drive motor 840, and the CST feeding solenoid 822 via the ASIC 802 to convey the recording material S. The toner image formed on the photosensitive drum 10 is transferred onto the recording material S at the transfer portion 15. The fixing unit 50 fixes the toner image onto the recording material S. The discharge roller pair 60 discharges the recording material S onto the first discharge unit 70 as a recording material stacking unit. To improve the alignment characteristics of recording materials, the first discharge unit 70 is provided with a gentle rising slope from the vicinity of the discharge port toward the recording material discharge direction. The CPU 801 supplies predetermined power from the low-voltage power source 811 to the fixing unit 50 to make the fixing unit 50 generate a desired heating value to heat the recording material S, so that the toner image thereon is melted and fixed onto the recording material S.

The following describes control operations performed by the control unit 800 at the time of document reading. Upon reception of a scanning command for instructing reading of the document sheet G from a host computer (not illustrated), the CPU 801 drives a two-sided flapper solenoid 820 and the two-sided drive motor 840 via the ASIC 802 to operate a document feeding solenoid 823. As a result, the torque of the two-sided drive motor 840 is transmitted to the document pickup roller 91, and the document sheet G is conveyed. The document reading unit 100 reads the document sheet G based on a CISSTART signal 902, a CISLED signal 903, a S1_in signal 912, a S1_select signal 913, and a SYSCLK signal 914 which are control signals from the ASIC 802. These control signals will be described in detail below. The CPU 801 stores in the image memory 804 connected to the ASIC 802 the read document image data output as a S1_out signal 910 from the document reading unit 100 through control via the ASIC 802. Then, the CPU 801 operates a switchback solenoid 821 to turn over the switchback flapper 82 toward the side of the document conveyance path 81, and reverses the two-sided drive motor 840 to convey the document sheet G to the second discharge unit 110.

Overview of Document Reading Unit

Figure 4:
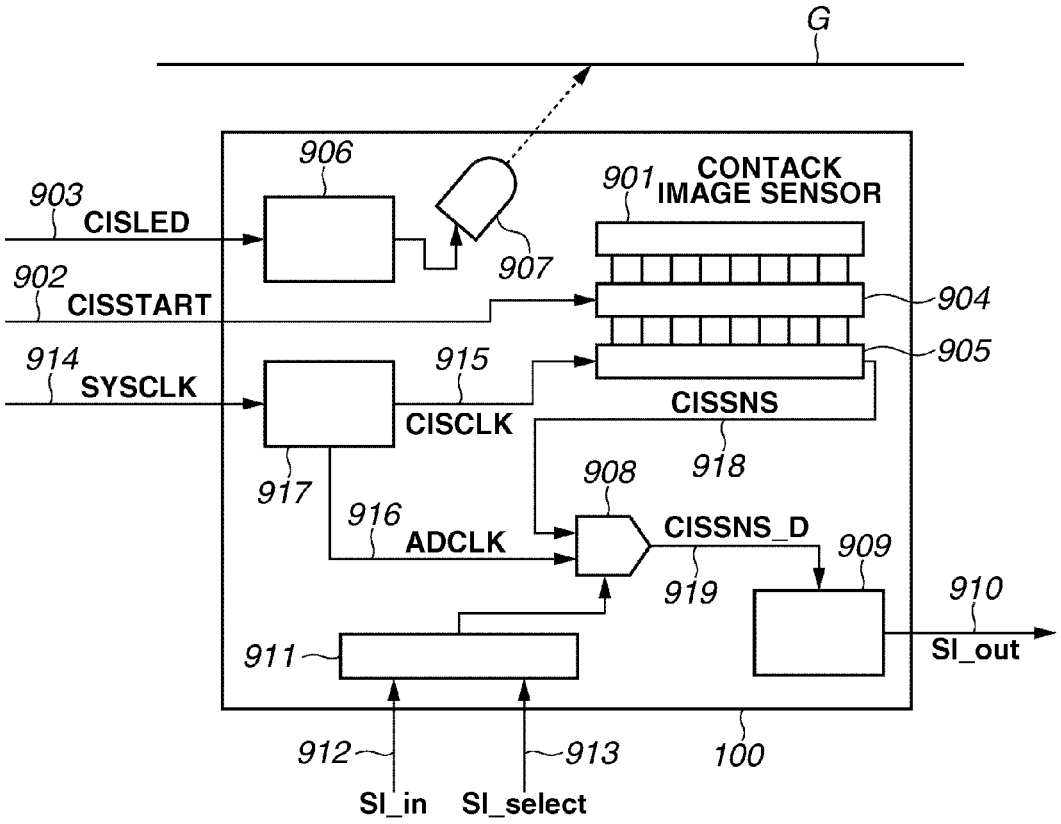
FIG. 4 is a block diagram illustrating a circuit configuration of a document reading unit according to the first to a fourth exemplary embodiments.

The following describes in detail the document reading unit 100 with reference to FIG. 4. FIG. 4 is a circuit block diagram of the document reading unit 100. Referring to FIG. 4, a contact image sensor (CIS) unit 901 includes, for example, photo diodes for 10,368 pixels arranged in array form with a certain main scanning density (for example, 1200 dots per inch (dpi)). The CISSTART signal 902 is a document reading start pulse signal input to the CIS sensor unit 901. The CISLED signal 903 is a control signal for controlling a light emitting element 907. A current amplifier unit 906 controls the current to be supplied to the light emitting element 907 based on the CISLED signal 903. The light emitting element 907 uniformly irradiates the document sheet G. A timing generator 917 inputs the SYSCLK signal 914, and generates an ADCLK signal 916 and a CISCLK signal 915. The SYSCLK signal 914 is a system clock for determining the operation speed of the document reading unit 100. The ADCLK signals 916 is a sampling clock for determining the sampling rate of an analog-to-digital (A/D) converter 908. The CISCLK signal 915 is used as a transfer clock for a CISSNS signal 918 which is an output signal of a shift register 905.

The following describes the document reading operation. When the CISSTART signal 902 becomes active, the CIS sensor unit 901 starts accumulating charges based on the light emitted from the light emitting element 907 and reflected by the document sheet G, and sequentially sets charge data accumulated in an output buffer 904. The timing generator 917 outputs to the shift register 905, for example, the CISCLK signal 915 having a clock frequency of about 500 kHz to 1 MHz. The shift register 905 outputs the charge data set in the output buffer 904 to the A/D converter 908 as the CISSNS signal 918 in synchronization with the input CISCLK signal 915. Since the CISSNS signal 918 includes a predetermined data guaranteed region, the A/D converter 908 needs to sample the CISSNS signal 918 when a predetermined time has elapsed since the rising timing of the CISCLK signal 915 (transfer clock). The CISSNS signal 918 is output from the shift register 905 in synchronization with both the rising and falling edges of the CISCLK signal 915 (transfer clock). Therefore, the timing generator 917 generates the ADCLK signal 916 and the CISCLK signal 915 so that the frequency of the ADCLK signal 916 (a clock for sampling the CISSNS signal 918) become twice the frequency of the CISCLK signal 915. Then, the CISSNS signal 918 is sampled on the rising edge of the ADCLK signal 916. The timing generator 917 divides the SYSCLK signal 914 (input system clock) to generate the ADCLK signal 916 and the CISCLK signal 915 (transfer clock). The phase of the ADCLK signal 916 lags behind the CISCLK signal 915 (transfer clock) by the amount of the above-described data guaranteed region.

The A/D converter 908 converts the CISSNS signal 918 to digital form, and outputs the digital signal to an output interface circuit 909 as a CISSNS_D signal 919. The output interface circuit 909 outputs the CISSNS_D signal 919 at a predetermined timing as the S1_out signal 910 (serial data). In that case, an analog output reference voltage is output to the CISSNS_D signal 919 for a predetermined number of pixels from the CISSTART signal 902 (start pulse). Those pixels cannot be used as an effective pixel.

Via the ASIC 802, a control circuit 911 controls the A/D conversion gain of the A/D converter 908 based on the S1_in signal 912 and the S1_select signal 913 from the CPU 801. For example, if the contrast of the read document image cannot be acquired, the CPU 801 increases the A/D conversion gain of the A/D converter 908 to increase the contrast, thus constantly reading the document with the best contrast.

Although the image forming apparatus 1 is configured to output image information of all pixels as the CISSNS_D signal 919 (output signal), the configuration is not limited thereto. The image forming apparatus 1 may be configured to divide pixels into a plurality of areas and simultaneously apply A/D conversion to the plurality of areas to achieve high-speed document reading. Although a CIS sensor is used for the document reading unit 100 in the first exemplary embodiment, the CIS sensor may be replaced with a complementary metal-oxide semiconductor (CMOS) sensor or a charge-coupled device (CCD) sensor.

Controlling Two-Sided Feeding-Reading of a Plurality of Document Sheets and Continuous Two-Sided Printing on a Plurality of Recording Materials The following describes a feature of the present exemplary embodiment, i.e., a process of two-sided reading of image information for a plurality of document sheets G and continuous two-sided printing of the image information on a plurality of recording materials S. When a plurality of recording materials S or document sheets G exists, the following designation rule is applied in descriptions to distinguish each of the plurality of recording materials S or document sheets G. For example, the plurality of recording materials S stored in the first sheet feed unit 30 is referred to as S1, S2, S3, and so on in order of conveyance at the time of image formation. Further, the plurality of document sheets G stored in the second sheet feed unit 90 is referred to as G1, G2, G3, and so on in order of conveyance at the time of document reading. When printing conditions of recording materials S need to be distinguished, a plurality of unprinted recording materials S is referred to as S1(0), S2(0), S3(0), and so on, and a plurality of recording materials S that has completed one-sided printing is referred to as S1(1), S2(1), S3(1), and so on. Further, a plurality of recording materials S that has completed two-sided printing is referred to as S1(2), S2(2), S3(2), and so on. Thus, the three different conditions (unprinted condition, one-sided printing condition, and two-sided printing condition) are distinguished. Unless a plurality of sheets is mentioned, one sheet is referred to as a recording material S or a document sheet G in descriptions.

Figure 5A:
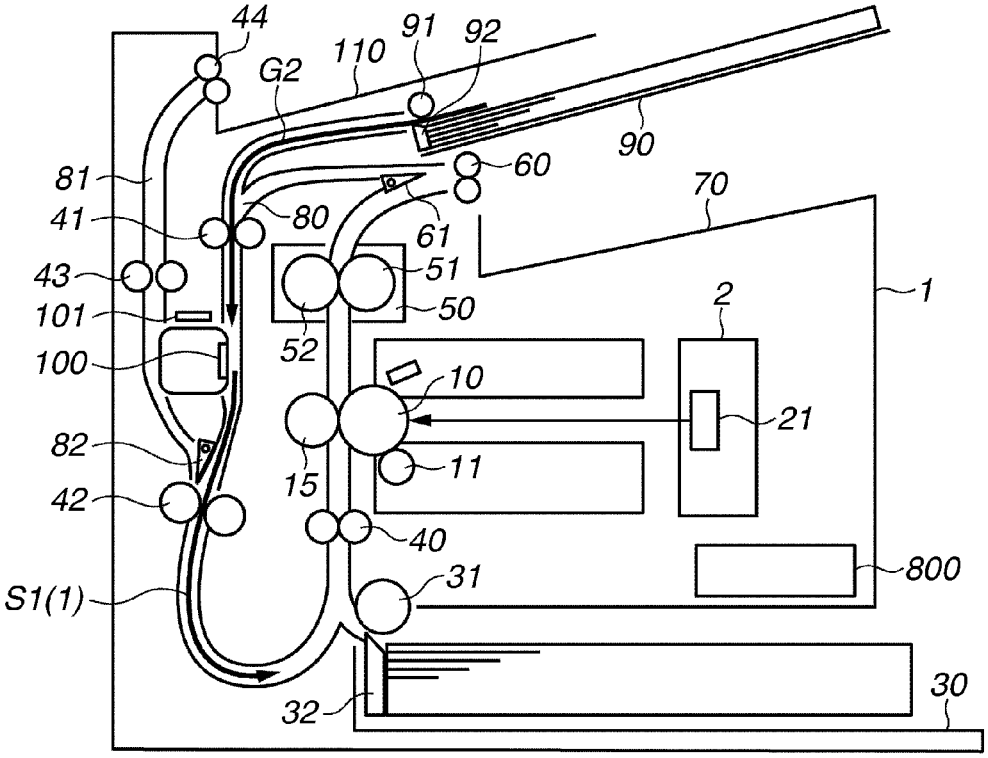
FIGS. 5A and 5B illustrate recording material and document conveyance operations according to the first exemplary embodiment.

The following descriptions will be made on the premise that two-sided feeding-reading for a document sheet G1 has been completed and the document sheet G1 has been discharged onto the second discharge unit 110, and that printing of the second side (back side) of the document sheet G1 on a recording material S1(1) has been completed. FIG. 5A illustrates a state where reading of the first side (front side) of a document sheet G2 is started, and a conveyance operation for the recording material S1(1). The recording material S1(1) passing through the common conveyance path 80 is conveyed to the transfer portion 15 again by the conveyance roller pairs 41 and 42. Almost at the same time, the document sheet G2 is conveyed from the second sheet feed unit 90 to the common conveyance path 80. At this timing, the CPU 801 adjusts the order of conveyance of the document sheet G2 so that the recording material S1(1) does not collide with the document sheet G2 in the common conveyance path 80, and that the document sheet G2 follows the trailing edge of the recording material S1(1).

To read image information of the first side (front side) of the document sheet G2 with the document reading unit 100, the CPU 801 rotates the document reading unit 100 toward the side of the common conveyance path 80 before the document sheet G2 has been sent out to the common conveyance path 80. While the document sheet G2 is passing the document reading unit 100, the document reading unit 100 reads the image information of the first side (front side) of the document sheet G2, and the image information is stored in the image memory 804.

Figure 5B:
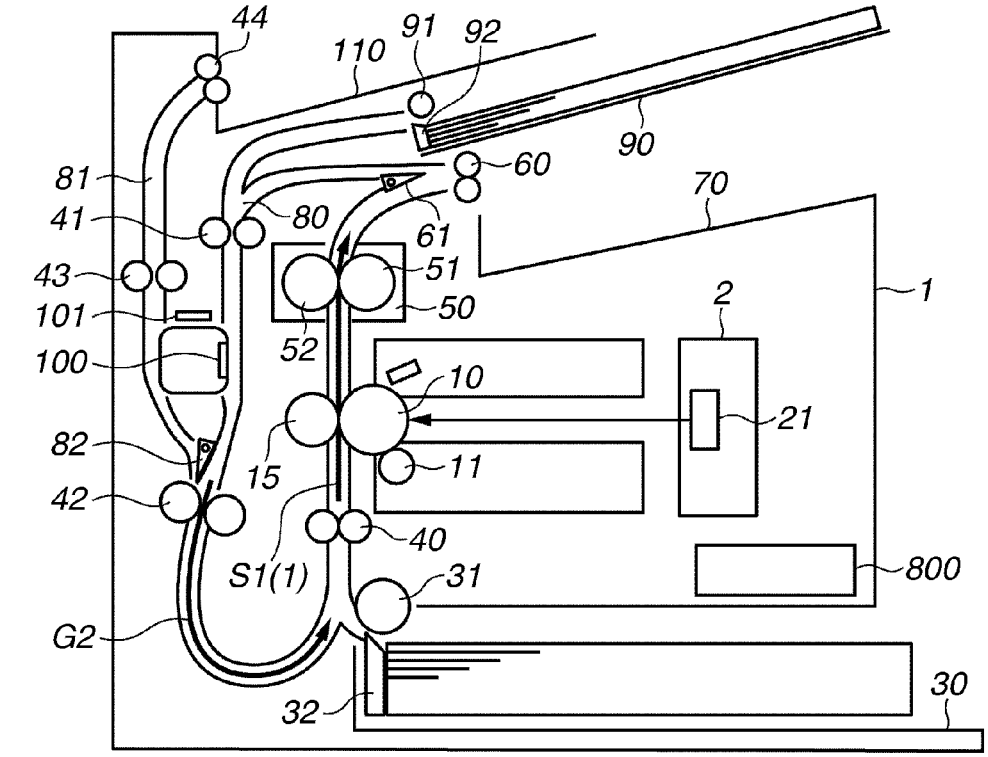

FIG. 5B illustrates a state where reading of the first side (front side) of the document sheet G2 has been completed, and an image forming process for the recording material S1(1). The conveyance roller pair 42 conveys the recording material S1(1) to the conveyance roller pair 40, and then conveys the document sheet G2. When the trailing edge of the document sheet G2 has passed the switchback flapper 82, the conveyance roller pair 42 stops while the conveyance roller pair 42 pinches the document sheet G2. The conveyance roller pair 40 conveys the recording material S1(1) to the transfer portion 15 and the fixing unit 50. The above-described image forming process forms on the recording material S1(1) a toner image based on the document image data for the first side (front side) of the document sheet G1 stored in the image memory 804. Since two-sided image formation for the recording material S1(1) has been completed, the recording material S1(1) is hereinafter referred to as a recording material S1(2).

Figure 5C:
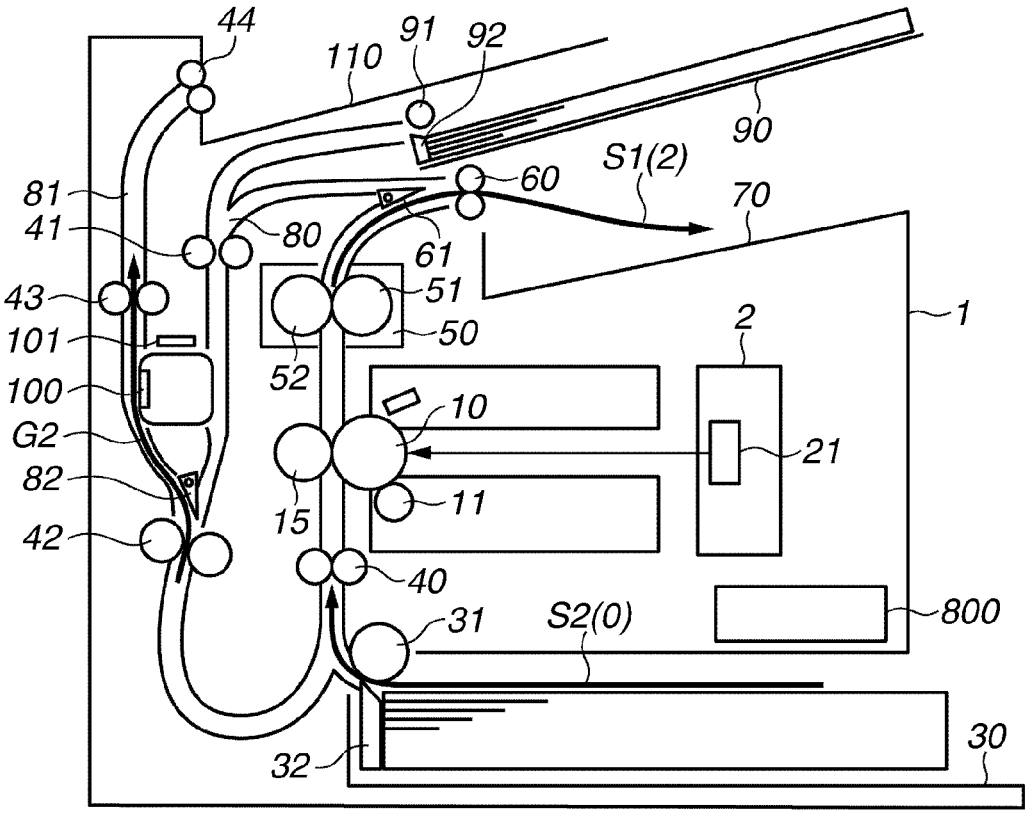
FIG. 5C illustrates conveyance operations of a recording material and a document according to the first exemplary embodiment.

FIG. 5C illustrates a reading process for the second side (back side) of the document sheet G2, and a conveyance operation for the recording material S1(2) and a recording material S2(0). After a predetermined time period has elapsed since the conveyance roller pair 42 stopped rotating, the switchback flapper 82 changes the conveyance path from the common conveyance path 80 to the document conveyance path 81. At the same time, the document reading unit 100 rotates to face the document conveyance path 81. Then, the conveyance roller pair 42 rotates in the reverse direction to convey the document sheet G2 to the document conveyance path 81. While the document sheet G2 is passing the document reading unit 100, the document reading unit 100 reads image information of the second side (back side) of the document sheet G2, and the image information is stored in the image memory 804. Almost at the same time as when the image information is stored in the image memory 804, the recording material S2(0) is conveyed from the first sheet feed unit 30 toward the transfer portion 15, preparing for forming on the recording material S2(0) an image of the second side of the document sheet G2. The recording material S1(2) printed thereon two-sided image information of the document sheet G1 is conveyed by the discharge roller pair 60, and then discharged onto the first discharge unit 70.

Figure 6A:
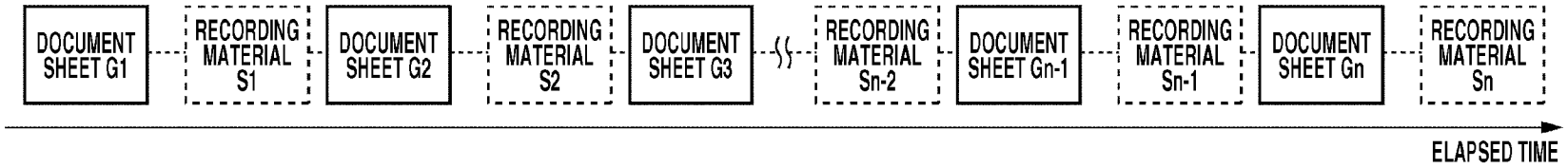
FIG. 6A illustrates the order of conveyance of document sheets and recording materials to a common conveyance path.

Order of Conveyance of Document and Recording Material to Common Conveyance Path Repetitively performing a process similar to the series of operations described with reference to FIGS. 5A to 5C enables continuous performance of the subsequent image forming processes for the recording materials S and the subsequent reading processes for the document sheets G. FIG. 6A illustrates the order of conveyance of the document sheets G and the recording materials S to the common conveyance path 80 according to the present exemplary embodiment. According to the above-described process, the order of conveyance of document sheets and recording materials to the common conveyance path 80 in a process of two-sided feeding-reading of n document sheets and two-sided printing on n recording materials is as follows. Specifically, the document sheets G and the recording materials S can be continuously conveyed in order of the document sheet G1, the recording material S1, the document sheet G2, the recording material S2, the document sheet G3, . . . , the recording material Sn-2, the document sheet Gn-1, the recording material Sn-1, the document sheet Gn, and the recording material Sn. FIG. 6A illustrates each document sheet G as a rectangle drawn with solid lines, and each recording material S as a rectangle drawn with broken lines. Thus, in the present exemplary embodiment, reading of the document sheet G and image formation on the recording material S can be performed while the document sheets G and the recording materials S are alternately conveyed to the common conveyance path 80 regardless of the number of document sheets G and the number of recording materials S. In that case, it is sufficient for the image memory 804 to have a capacity for storing image information of the two sides (front and back sides) of one document sheet G. Thus, the image forming apparatus 1 can be inexpensively configured while the image forming apparatus 1 increases the productivity of printing on recording materials. This is how the CPU 801 completes the process of two-sided reading of image information for a plurality of document sheets G and of continuous two-sided printing of the image information on a plurality of recording materials S.

Controlling Conveyance Speeds of Document and Recording Material

Figure 7:
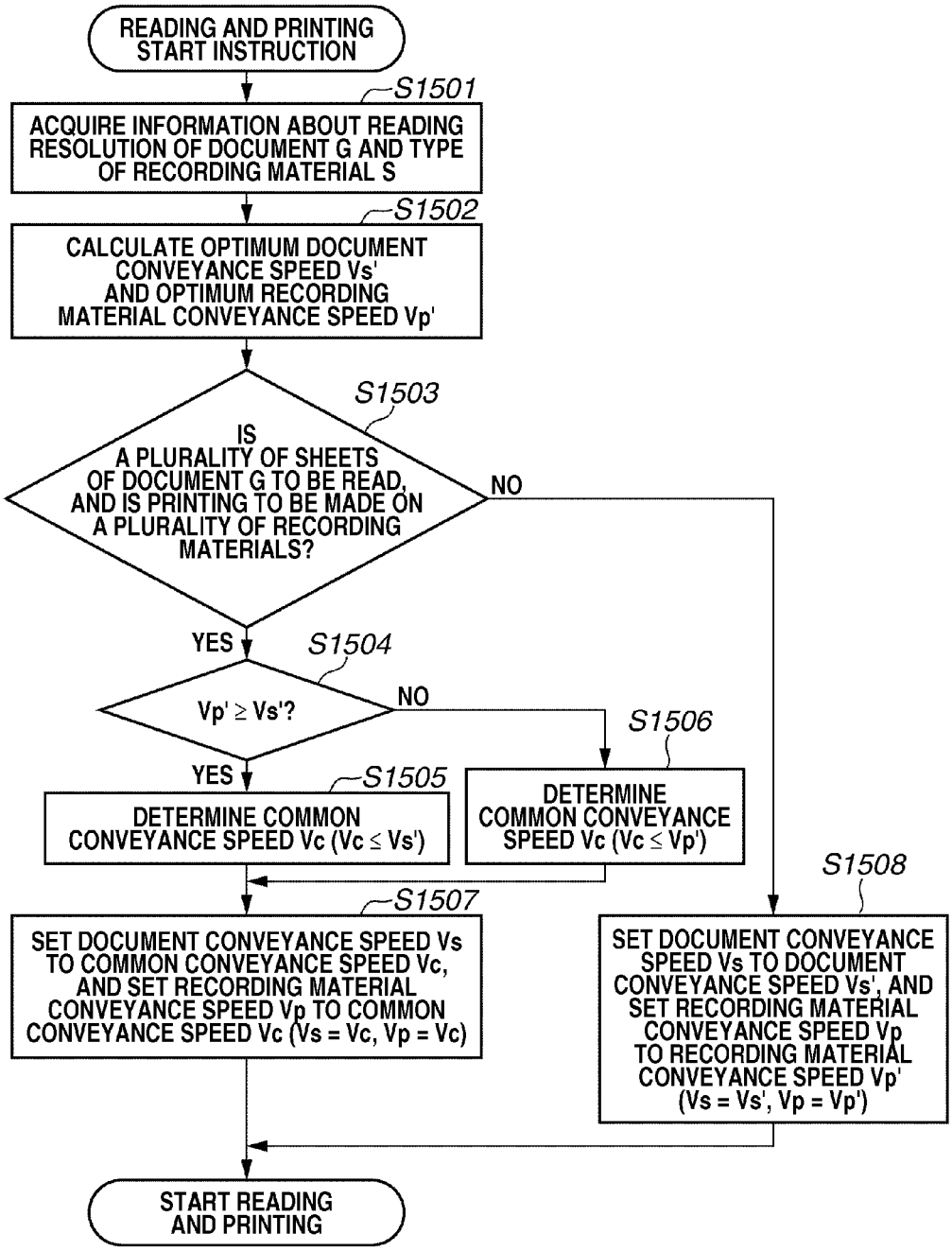
FIG. 7 is a flowchart illustrating an operation of a central processing unit (CPU) according to the first exemplary embodiment.

In the above-described process of two-sided reading of image information for a plurality of document sheets G and continuous two-sided printing of the image information on a plurality of recording materials S, the document sheet G is conveyed at a conveyance speed Vs, and the recording material S is conveyed at a conveyance speed Vp. How the CPU 801 determines the conveyance speeds Vs and Vp will be described below with reference to FIG. 7. Regularly, in a configuration without a common conveyance path for the document sheet G and the recording material S, the conveyance speeds Vs and Vp can be controlled based on respective optimum conveyance speeds. Specifically, the conveyance speed Vs is determined by the resolution required for reading of the document sheet G, and the conveyance speed Vp is determined by the type of the recording material S. Upon reception of an instruction for starting two-sided feeding-reading for the document sheet G and two-sided printing on the recording material S from a host computer (not illustrated), in step S1501, the CPU 801 acquires information about a document image reading resolution setting and a recording material type setting from the host computer. In step S1502, based on those pieces of information, the CPU 801 calculates and predetermines an optimum document conveyance speed Vs' and an optimum recording material conveyance speed Vp'. Since the method for calculating the optimum document conveyance speed Vs' and the optimum recording material conveyance speed Vp' is well-known, descriptions thereof will be omitted in the present and subsequent exemplary embodiments.

Figure 6B:
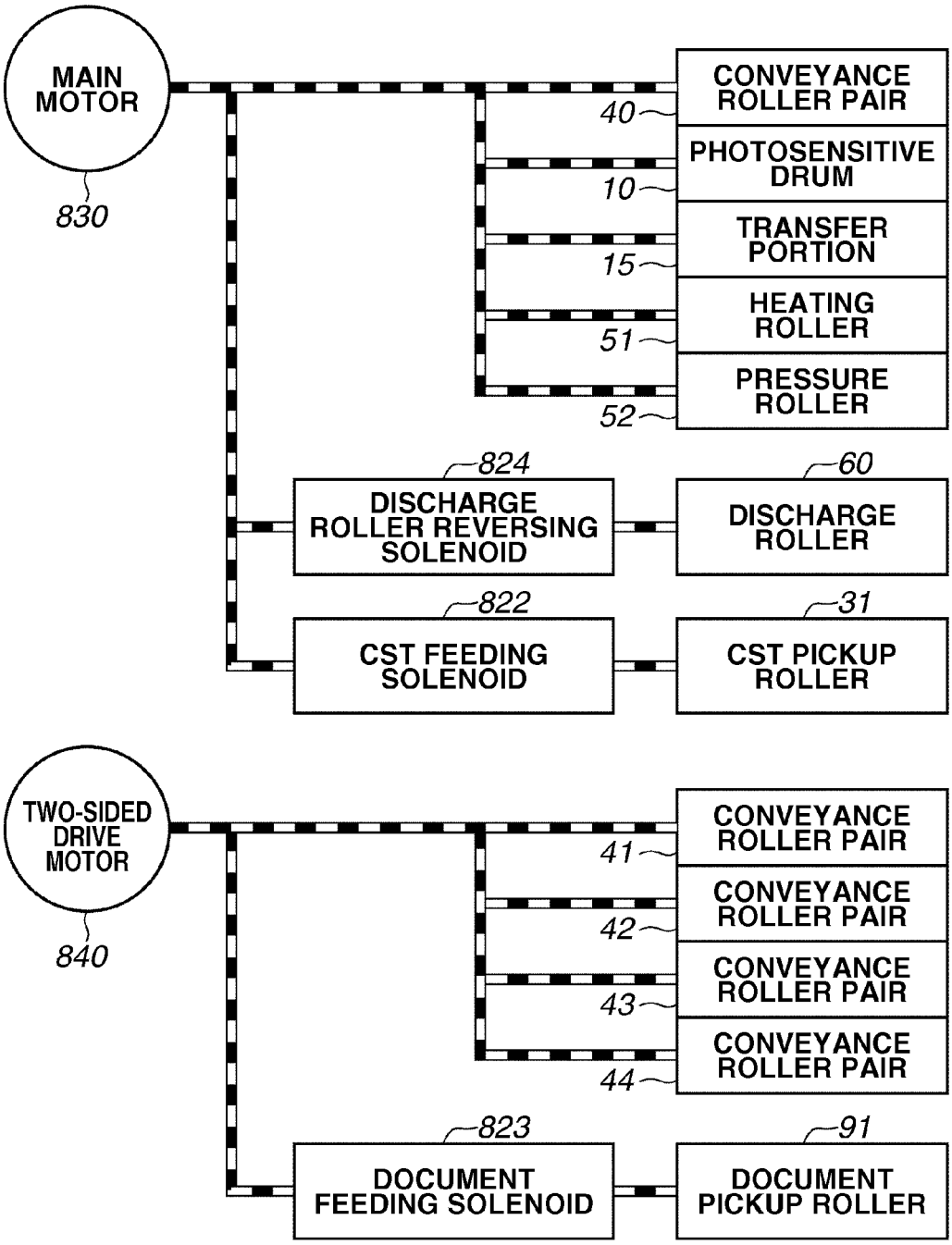
FIG. 6B illustrates driving systems according to the first exemplary embodiment.

When two-sided printing is to be performed, the common conveyance path 80 is used as a common conveyance path for the document sheet G and the recording material S. FIG. 6B illustrates driving systems according to the present exemplary embodiment. The main motor 830 (first drive source) drives the conveyance roller pair 40, the photosensitive drum 10, the transfer portion 15, the heating roller 51, and the pressure roller 52. The main motor 830 drives the discharge roller pair 60 via the discharge roller reversing solenoid 824, and drives the CST pickup roller 31 via the CST feeding solenoid 822. On the other hand, the two-sided drive motor 840 (second drive source) drives the conveyance roller pairs 41 to 44, and drives the document pickup roller 91 via the document feeding solenoid 823.

As illustrated in FIG. 6B, the discharge roller pair 60 and the conveyance roller pair 40 are driven by the main motor 830, and the conveyance roller pairs 41 and 42 are driven by the two-sided drive motor 840. In that case, if the main motor 830 and the two-sided drive motor 840 are controlled so that the conveyance speed Vp' is simply achieved in the recording material conveyance path between the conveyance roller pair 40 and the discharge roller pair 60, and that the conveyance speed Vs' is simply achieved in the common conveyance path 80, the following problem arises. Specifically, when the configuration of the present exemplary embodiment is used, a state (for example, FIG. 1B) where the recording material S is pinched by the discharge roller pair 60 driven by the main motor 830 and the conveyance roller pair 41 driven by the two-sided drive motor 840 arises. Further, a state (for example, FIG. 2E) where the recording material S is pinched by the conveyance roller pair 42 driven by the two-sided drive motor 840 and the conveyance roller pair 40 driven by the main motor 830 arises. When the recording material S is pinched by two roller pairs driven by different drive sources and the two roller pairs rotates at different speeds (Vp' and Vs') in this way, a distortion of the conveyed recording material S may occur. Therefore, in the configuration of the present exemplary embodiment, when the document sheet G and the recording material S use the common conveyance path 80, the CPU 801 sets the conveyance speeds Vs and Vp to an identical speed.

However, when the image forming apparatus 1 performs two-sided feeding-reading of one document sheet G and two-sided printing on a sheet of recording material S, the document sheet G and the recording material S do not use the common conveyance path 80 in a competitive way, and, therefore, the recording material S is not pinched by two roller pairs driven by different drive sources. In step S1503, therefore, the CPU 801 determines whether the printing instruction is an instruction for reading of a plurality of document sheets G and printing on a plurality of recording materials S. When the CPU 801 determines that the printing instruction is not an instruction for reading of a plurality of document sheets G and printing on a plurality of recording materials S (NO in step S1503), i.e., the printing instruction is an instruction for reading of one document sheet G and two-sided printing on one recording material S, the processing proceeds to step S1508. In step S1508, the CPU 801 sets the document conveyance speed Vs to the optimum document conveyance speed Vs' calculated in step S1502, (Vs=Vs'), and sets the recording material conveyance speed Vp to the optimum recording material conveyance speed Vp' calculated in step S1502 (Vp=Vp'). Then, the CPU 801 starts reading of the document sheet G and printing on the recording material S.

Otherwise, when the CPU 801 determines that the printing instruction is an instruction for reading of a plurality of document sheets G and printing on a plurality of recording materials S (YES in step S1503), the processing proceeds to step S1504. The following describes processing performed by the CPU 801 in step S1504 and subsequent steps. When the document conveyance speed and the recording material conveyance speed are set to an identical speed, the identical speed is referred to as a common conveyance speed Vc. In step S1504, the CPU 801 compares the optimum document conveyance speed Vs' with the optimum recording material conveyance speed Vp' to determine whether the optimum recording material conveyance speed Vp' is equal to or higher than the optimum document conveyance speed Vs'. When the CPU 801 determines that the optimum recording material conveyance speed Vp' is equal to or higher than the optimum document conveyance speed Vs', i.e., the optimum document conveyance speed Vs' is lower (YES in step S1504), the processing proceeds to step S1505. In step S1505, the CPU 801 sets the common conveyance speed Vc to a conveyance speed equal to or lower than the optimum document conveyance speed Vs' (Vc≤Vs'). Otherwise, when the CPU 801 determines that the optimum recording material conveyance speed Vp' is not equal to or higher than the optimum document conveyance speed Vs', i.e., the optimum recording material conveyance speed Vp' is lower (NO in step S1504), the processing proceeds to step S1506. In step S1506, the CPU 801 sets the common conveyance speed Vc to a conveyance speed equal to or lower than the optimum recording material conveyance speed Vp' (Vc≤Vp'). Specifically, in the present exemplary embodiment, the common conveyance speed Vc is controlled to be equal to or lower than the optimum document conveyance speed Vs' or the optimum recording material conveyance speed Vp', whichever is lower. In step S1507, the CPU 801 sets both the conveyance speeds Vs and Vp to the common conveyance speed Vc (Vs=Vc, Vp=Vc), and then starts document reading and image formation.

The reason for the above-described operations of the CPU 801 will be described below. Document reading is sufficiently possible when the conveyance speed is lower than the conveyance speed required for the reading resolution. Further, image formation is possible when the conveyance speed is lower than the conveyance speed required for the image forming process. Therefore, when the CPU 801 determines that the printing instruction is an instruction for reading of a plurality of document sheets G and printing on a plurality of recording materials S, setting the conveyance speeds Vs and Vp to the common conveyance speed Vc via the above-described control does not cause inconvenience arising both in the document reading process and in the image forming process. Thus, the conveyance speeds in the document reading process and in the image forming process can be set to an identical speed.

Although, in the present exemplary embodiment, the conveyance speeds Vs and Vp are set to the common conveyance speed Vc, the conveyance speeds Vs and Vp do not necessarily coincide with each other because of fluctuations in speed of the drive sources or errors in the mechanical structure. However, even if the conveyance speeds Vs and Vp are controlled so that the speed difference therebetween falls within a predetermined range including such fluctuations and errors, the contents described in the present exemplary embodiment are achieved. When the speed difference between the conveyance speeds Vs and Vp is zero, control is performed with the conveyance speeds Vs and Vp set to the common conveyance speed Vc.

According to the configuration of the present exemplary embodiment, speed control is performed to set the conveyance speeds Vs and Vp to the common conveyance speed Vc, or to set the speed difference between the conveyance speeds Vs and Vp within a predetermined range while the conveyance speeds Vs and Vp are set to the common conveyance speed Vc or below. This control enables achievement of a process of two-sided reading of image information of a plurality of document sheets G and continuous two-sided printing of the image information on a plurality of recording materials S with an inexpensive apparatus configuration without requiring complicated speed control.

Thus, according to the present exemplary embodiment, it is possible to prevent degradation of the productivity in a case where a document reading operation and a printing operation are performed in parallel with a configuration in which a recording material and a document share a common conveyance path.

A second exemplary embodiment will be described below. The first exemplary embodiment describes speed control of the conveyance speeds Vs and Vp in the process of two-sided feeding-reading of a plurality of document sheets G and two-sided printing on a plurality of recording materials S. In the present exemplary embodiment, speed control of the conveyance speeds Vs and Vp in the process of two-sided feeding-reading of a plurality of document sheets G and one-sided printing on a plurality of recording materials S will be described below. In the present exemplary embodiment, the overall configuration of the image forming apparatus 1 and the block configuration of the control unit 800 are similar to those in the first exemplary embodiment, and detailed descriptions thereof will not be repeated. Further, the notation of a plurality of document sheets (G1, G2, . . . , ) and a plurality of recording materials (S1, S2, . . . , ) is similar to that in the first exemplary embodiment, and redundant descriptions thereof will not be repeated. However, in the present exemplary embodiment, a plurality of unprinted recording materials S is referred to as S1(0), S2(0), S3(0), and so on, and a plurality of recording materials S that has completed one-sided printing is referred to as S1(1), S2(1), S3(1), and so on. Thus, the two different conditions (unprinted condition and one-sided printing condition) are distinguished.

Figure 8A:
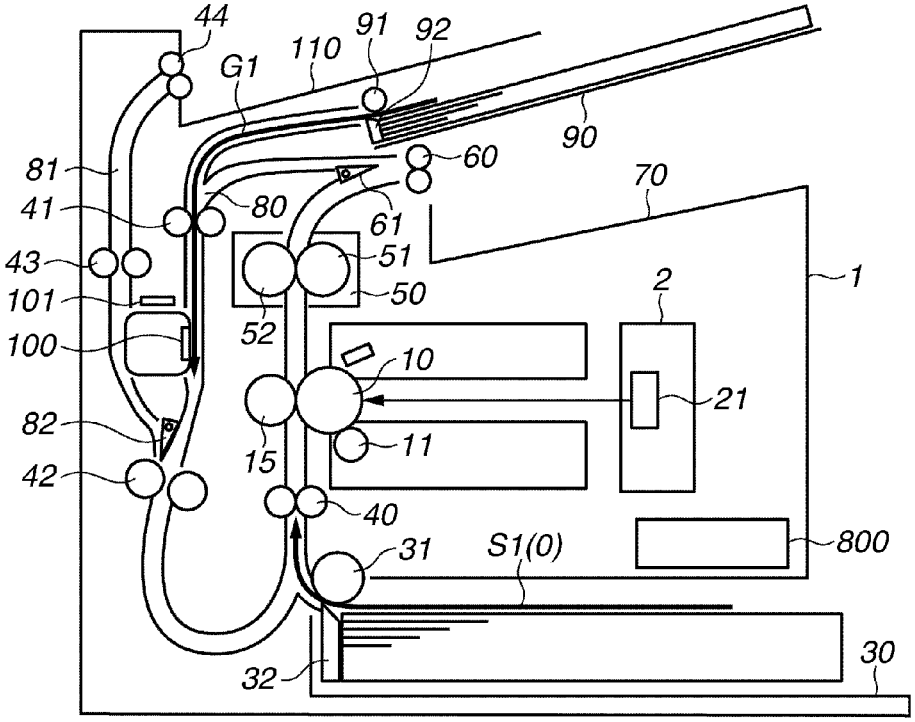
FIGS. 8A and 8B illustrate conveyance operations of a recording material and a document according to a second exemplary embodiment.

Controlling Two-Sided Feeding-Reading of a Plurality of Document Sheets and Continuous One-Sided Printing on a Plurality Recording Materials FIG. 8A illustrates a reading process for the first side (front side) of the document sheet G1, and a state where the conveyance of a recording material S1(0) is started. Similar to the first exemplary embodiment, when the document sheet G1 is conveyed from the second sheet feed unit 90 to the common conveyance path 80, the document reading unit 100 reads image information of the first side (front side) of the document sheet G1, and the image information is stored in the image memory 804. Almost at the same time, the recording material S1(0) is conveyed from the first sheet feed unit 30 to the transfer portion 15 to prepare for image formation.

Figure 8B:
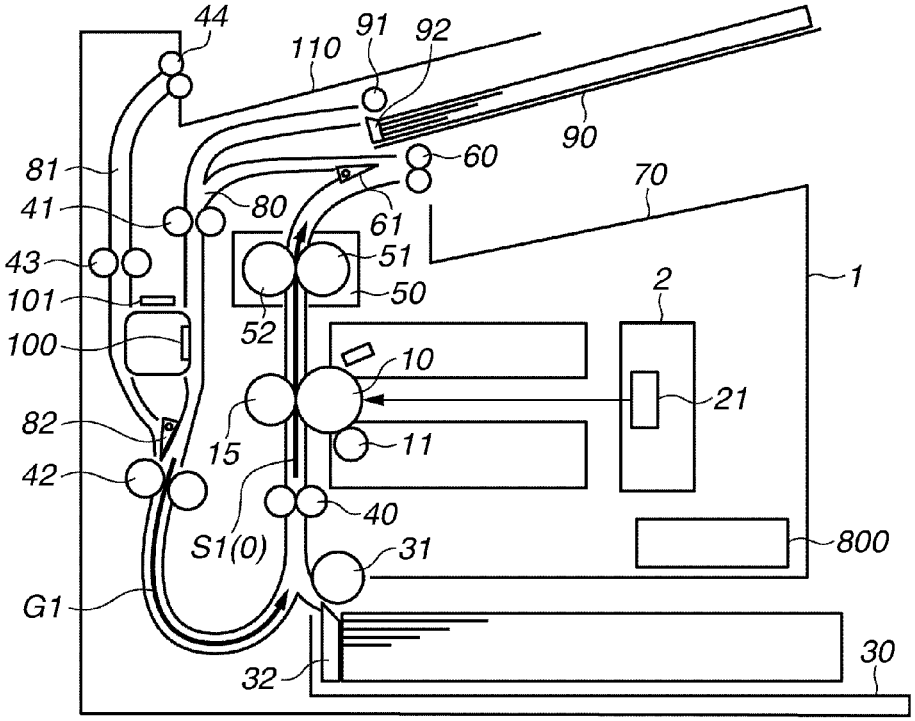

FIG. 8B illustrates a state where reading of the first side (front side) of the document sheet G1 has been completed, and an image forming process for the recording material S1(0). Upon completion of reading of the image information of the first side (front side) of the document sheet G1, the conveyance roller pair 42 continues conveyance of the document sheet G1. When the trailing edge of the document sheet G1 has passed the switchback flapper 82, the conveyance roller pair 42 stops rotating with the document sheet G1 pinched by the conveyance roller pair 42. In the meantime, the conveyance roller pair 40 conveys the recording material S1(0) to the transfer portion 15 and the fixing unit 50. The above-described image forming process performs image formation on the recording material S1(0) for the first side (front side) of the document sheet G1. Since image formation on one side of the recording material S1(0) has been completed, the recording material is hereinafter referred to as S1(1).

Figure 8C:
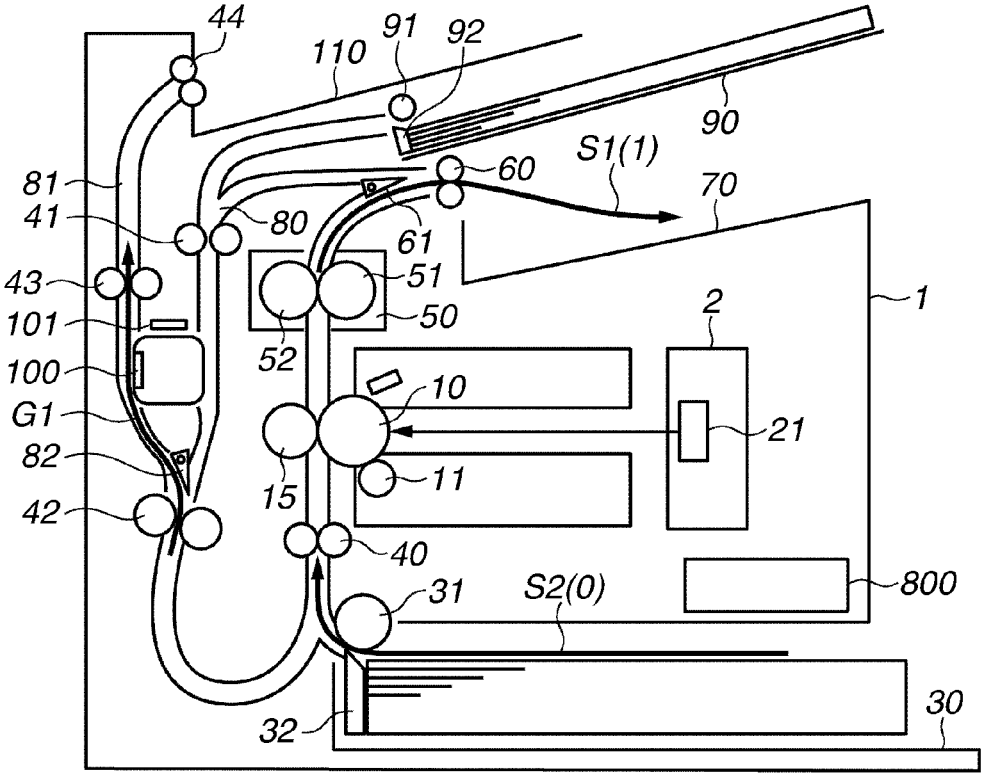
FIG. 8C illustrates conveyance operations of a recording material and a document according to the second exemplary embodiment.

FIG. 8C illustrates a reading process for the second side (back side) of the document sheet G1, and a conveyance operation for the recording materials S1(1) and S2(0). After a predetermined time period has elapsed since the conveyance roller pair 42 stopped rotating, the switchback flapper 82 changes the conveyance path from the common conveyance path 80 to the document conveyance path 81. At the same time, the document reading unit 100 rotates to face the document conveyance path 81. Then, the conveyance roller pair 42 rotates in the reverse direction to convey the document sheet G1 to the document conveyance path 81. While the document sheet G1 is passing the document reading unit 100, the document reading unit 100 reads the second side (back side) of the document sheet G1, and image information is stored in the image memory 804. Almost at the same time when the image information is stored in the image memory 804, the recording material S2(0) is conveyed from the first sheet feed unit 30 toward the conveyance roller pair 40, preparing for forming on the recording material S2(0) an image of the second side (back side) of the document sheet G2. The recording material S1(1) printed thereon the image of the first page (front page) of the document sheet G1 is conveyed by the discharge roller pair 60, and then discharged onto the first discharge unit 70.

Order of Conveyance of Document and Recording Material

Repetitively performing a process similar to the series of operations described with reference to FIGS. 8A to 8C enables continuous performance of the subsequent image forming processes for the recording materials S and the subsequent reading processes for the document sheets G. In the case of one-sided printing on the recording material S according to the present exemplary embodiment, the recording material S is not conveyed to the common conveyance path 80, and, therefore, it is not necessary to alternately convey the document sheet G and the recording material S to the common conveyance path 80, unlike the first exemplary embodiment illustrated in FIG. 6A. Therefore, it is desirable to convey the plurality of recording materials S one by one, and perform image formation for the image information each time the image information of the first side (front side) of the document sheet G or the image information of the second side (back side) thereof is stored in the image memory 804. This is how the CPU 801 completes the process of two-sided reading of image information of a plurality of document sheets G and of continuous one-sided printing of the image information on a plurality of recording materials S.

Although the above-described process performs two-sided reading of image information of a plurality of document sheets G, the configuration is not limited thereto. It is also possible to read image information printed on one side (front side or back side) of a plurality of document sheets G, and continuously print the one-side image information on one side of a plurality of recording materials S. When image information printed on one side of the document sheet G is read, the image information of the document sheet G is not distinguished in terms of the first side and the second side. One document sheet G corresponds to one piece of image information. Then, the image forming apparatus 1 reads one-side image information printed on the front side of the document sheet G via the document reading unit 100 when the document sheet G passes through the common conveyance path 80, or reads one-side image information printed on the back side of the document sheet G via the document reading unit 100 when the document sheet G passes the document conveyance path 81. Specifically, the image forming apparatus 1 desirably reads the one side image information on the front or back side of the document sheet G, and performs image formation on the recording material S based on the read one-side image information of the document sheet G. Two-sided feeding-reading is not required.

Controlling Conveyance Speeds of Document and Recording Material

Figure 9:
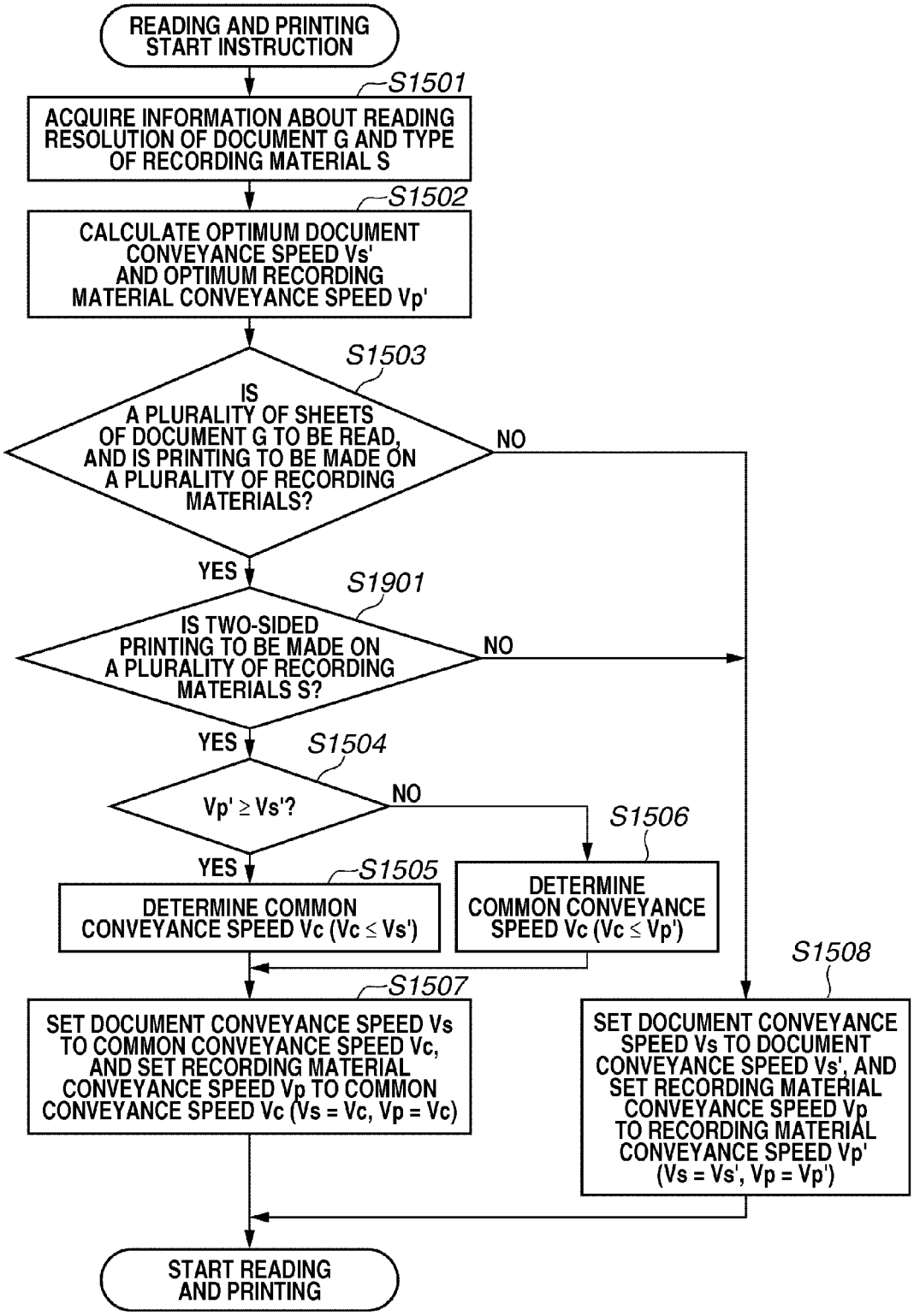
FIG. 9 is a flowchart illustrating an operation of the CPU according to the second exemplary embodiment.

Similar to the first exemplary embodiment, the document sheet G is conveyed at the conveyance speed Vs, and the recording material S is conveyed at the conveyance speed Vp. How the CPU 801 determines the conveyance speeds Vs and Vp will be described below with reference to FIG. 9. The operations of the CPU 801 in steps S1501 to S1508 illustrated in FIG. 9 have specifically been described with reference to FIG. 7 (a flowchart according to the first exemplary embodiment), detailed descriptions thereof will not be repeated. In the present exemplary embodiment, different from the first exemplary embodiment, when the CPU 801 determines in step S1503 that the printing instruction is on reading of a plurality of document sheets G and printing on a plurality of recording materials S, the processing proceeds to step S1901. In step S1901, the CPU 801 determines whether two-sided printing is to be made on a plurality of recording materials S. When the CPU 801 determines that two-sided printing is not to be made on a plurality of recording materials S, i.e., one-sided printing is to be made on the recording materials S (NO in step S1901), the processing proceeds to step S1508. When one-sided printing is to be made on the recording material S, the recording material S does not pass the common conveyance path 80. Therefore, the conveyance speed Vs is desirably controlled to be the optimum conveyance speed Vs' by a conveyance mechanism driven by the two-sided drive motor 840. Further, the conveyance speed Vp is desirably controlled to be the optimum conveyance speed Vp' by a conveyance mechanism driven by the main motor 830. When the CPU 801 determines that two-sided printing is to be made on a plurality of recording materials S (YES in step S1901), the processing proceeds to step S1504.

According to the configuration of the present exemplary embodiment, when one-sided printing is to be made on a plurality of recording materials S, the conveyance speeds Vs and Vp can be controlled to be the optimum conveyance speeds Vs' and Vp', respectively, thus improving the productivity of one-sided printing on the recording materials S to a further extent.

Thus, according to the present exemplary embodiment, it is possible to prevent degradation of the productivity in a case where a document reading operation and a printing operation are performed in parallel with a configuration in which a recording material and a document share a common conveyance path.

Overview of Control Unit of Image Forming Apparatus

Figure 10:
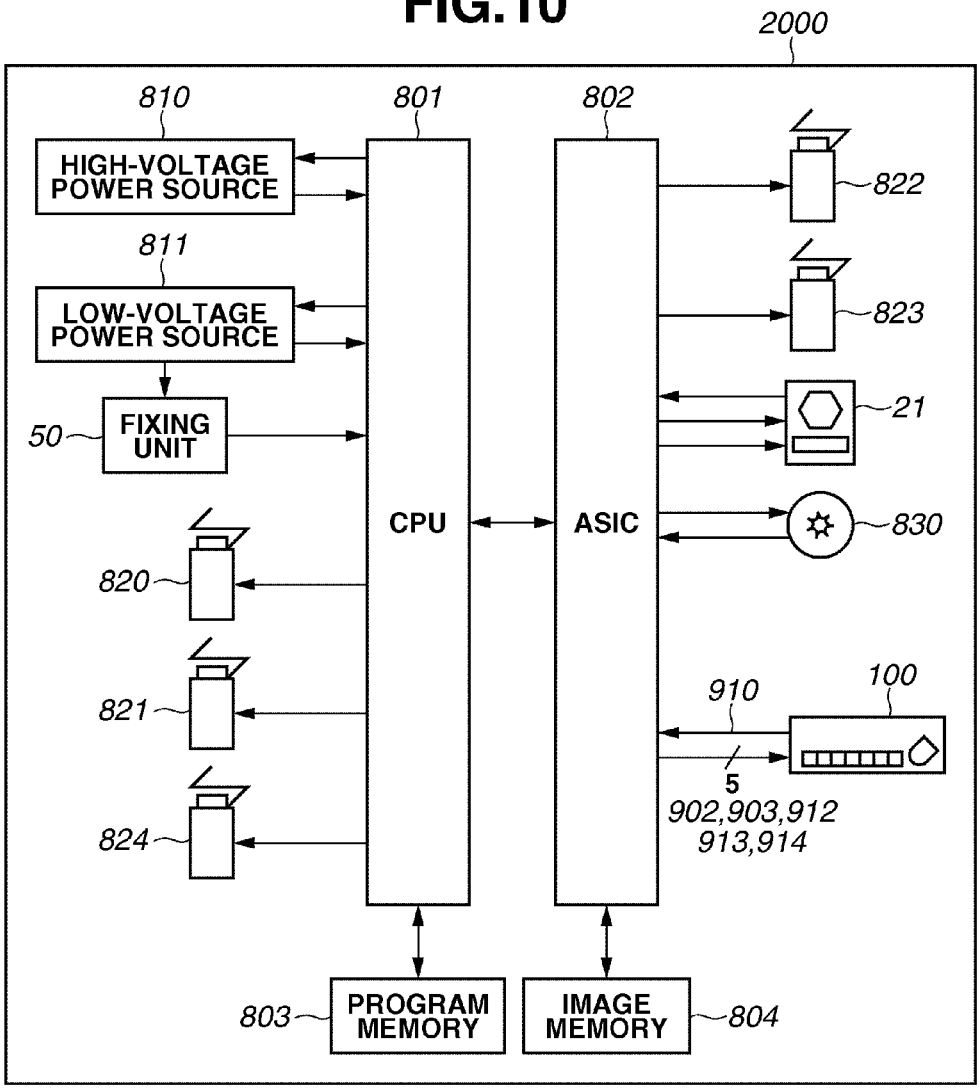
FIG. 10 is a block diagram illustrating a configuration of a control unit according to a third exemplary embodiment.

A third exemplary embodiment will be described below. The third exemplary embodiment differs from the first and second exemplary embodiments in that the image forming apparatus 1 includes a single drive source. The overall configuration of the image forming apparatus 1 is similar to that according to the first exemplary embodiment, and detailed descriptions thereof will not be repeated. However, the present exemplary embodiment differs from the first exemplary embodiment in that the image forming apparatus 1 includes a control unit 2000 instead of the control unit 800. The control unit 2000 will be described below. FIG. 10 illustrates the control unit 2000 centering on the CPU 801 of the image forming apparatus 1 according to the present exemplary embodiment. As illustrated in FIG. 10, the image forming apparatus 1 includes only the main motor 830 as a drive source. Since other components are similar to those in the first exemplary embodiment illustrated in FIG. 3, identical components are assigned the same reference numeral, and redundant descriptions thereof will not be repeated.

Driving System Schematic View

Figure 11:
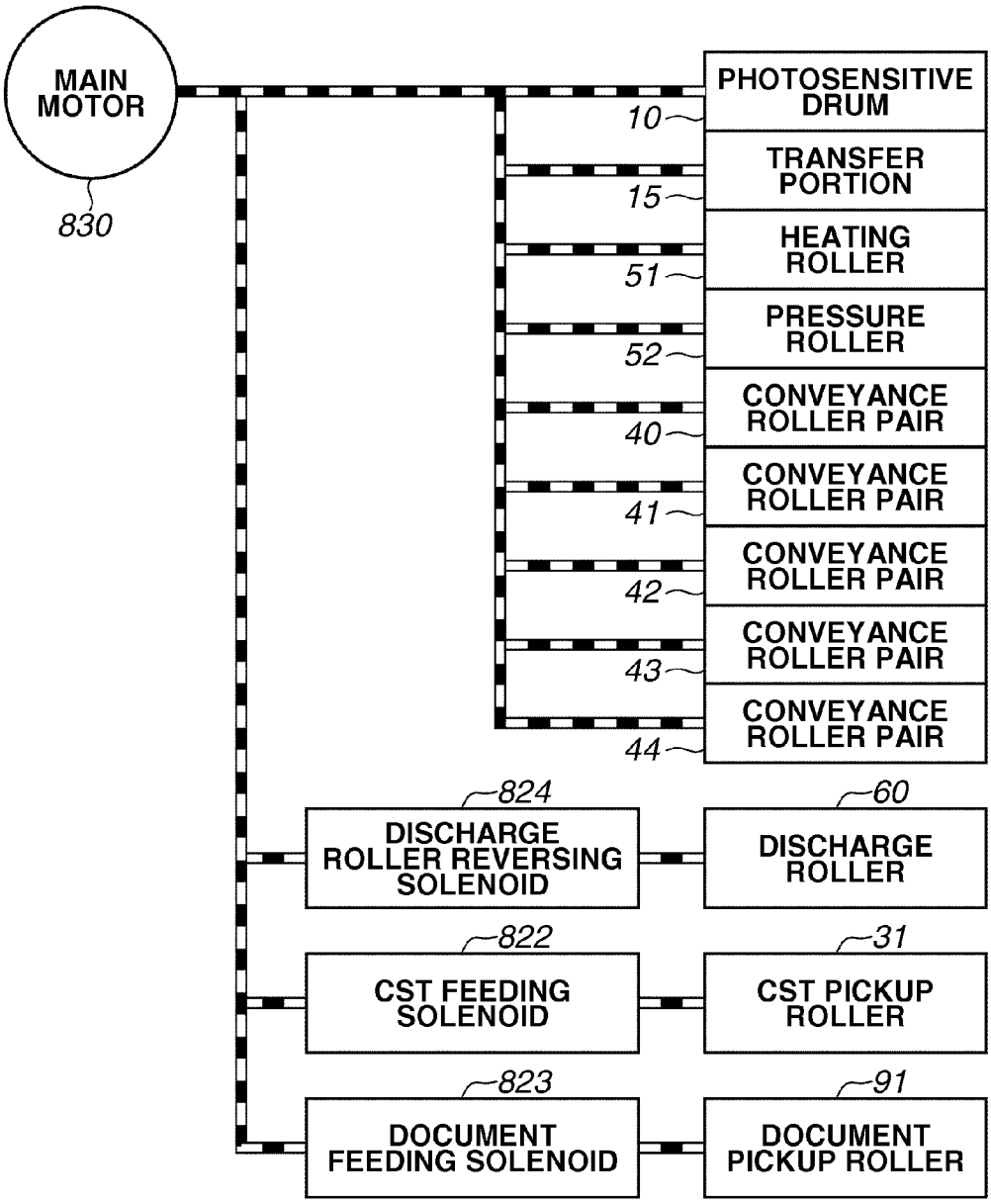
FIG. 11 illustrates a driving system according to the third exemplary embodiment.

FIG. 11 is a schematic view illustrating a driving system according to the present exemplary embodiment. As illustrated in FIG. 11, the photosensitive drum 10, the transfer portion 15, the heating roller 51, the pressure roller 52, the conveyance roller pair 40, the discharge roller pair 60, and the CST pickup roller 31 are driven by the main motor 830, similar to the first exemplary embodiment illustrated in FIG. 6B. In the present exemplary embodiment, the conveyance roller pairs 41 to 44 and the document pickup roller 91, driven by the two-sided drive motor 840 in the first exemplary embodiment, are also driven by the main motor 830.

Document reading process and the image forming process are similar to those in the first and second exemplary embodiments, detailed descriptions thereof will not be repeated. Similar to the first exemplary embodiment, the document sheet G is conveyed at the conveyance speed Vs, and the recording material S is conveyed at the conveyance speed Vp. With the configuration according to the present exemplary embodiment, the conveyance speeds Vs and Vp are constantly controlled according to the common conveyance speed Vc, regardless of one-sided printing on the recording material S or two-sided printing on the recording material S. Further, since only one drive source is used, the conveyance speeds Vs and Vp are controlled according to the common conveyance speed Vc even in the case of two-sided feeding-reading of one document sheet G and printing on one recording material S. Similar to the first exemplary embodiment, the common conveyance speed Vc is controlled to be equal to or lower than the optimum document conveyance speed Vs' or the optimum recording material conveyance speed Vp', whichever is lower. In the present exemplary embodiment, the CPU 801 performs the processing in step S1502 and then the processing in step S1504 in FIG. 7 (a flowchart according to the first exemplary embodiment).

The configuration of the present exemplary embodiment differs from that of the first and second exemplary embodiments in that only the main motor 830 is used as a drive source. Therefore, even when the common conveyance path 80 is not used for image formation for the recording material S, or when the document sheet G and the recording material S do not compete to use the common conveyance path 80, the conveyance speeds Vs and Vp cannot be controlled to be the optimum conveyance speeds Vs' and Vp', respectively. However, the present exemplary embodiment requires less number of drive sources than the first and second exemplary embodiments, enabling more inexpensive apparatus configuration.

Thus, according to the present exemplary embodiment, it is possible to prevent degradation of the productivity in a case where a document reading operation and a printing operation are performed in parallel with a configuration in which a recording material and a document share a common conveyance path.

Overview of Control Unit of Image Forming Apparatus

Figure 12:
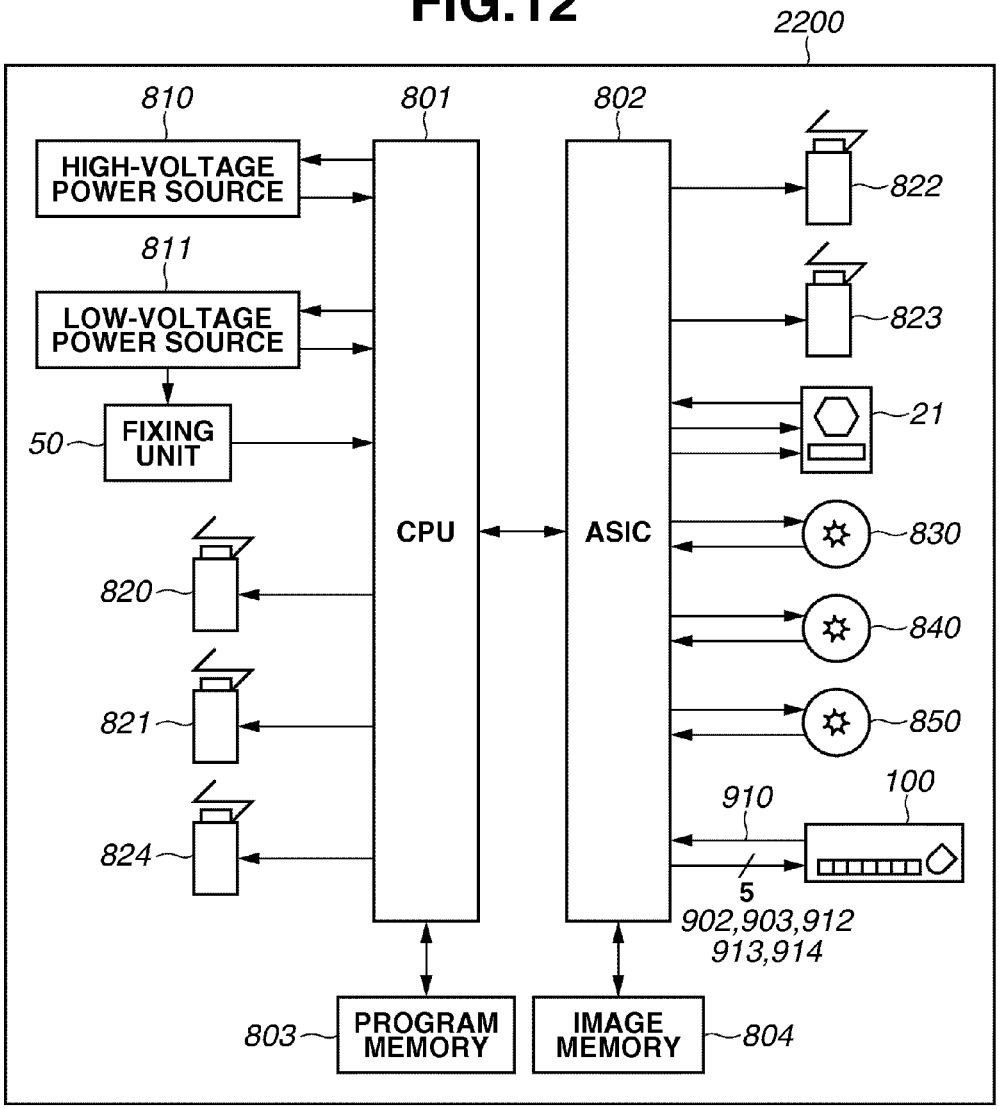
FIG. 12 is a block diagram illustrating a configuration of a control unit according to the fourth exemplary embodiment.

A fourth exemplary embodiment will be described below. The first exemplary embodiment is configured so that the recording material S1 passes through the common conveyance path 80 before the document sheet G2 does (refer to FIGS. 5A and 6A). The fourth exemplary embodiment differs from the first exemplary embodiment in that the document sheet G2 passes through the common conveyance path 80 before the recording material S1 does. The overall configuration of the image forming apparatus 1 is similar to that in the first exemplary embodiment, and detailed descriptions thereof will not be repeated. However, the present exemplary embodiment differs from the first exemplary embodiment in that the image forming apparatus 1 includes a control unit 2200 instead of the control unit 800. The control unit 2200 will be described below. FIG. 12 illustrates the control unit 2200 centering on the CPU 801 of the image forming apparatus 1 according to the present exemplary embodiment. The present exemplary embodiment differs from the first exemplary embodiment illustrated in FIG. 3 in the use of a document inversion drive motor 850 controlled by the ASIC 802. Other components are similar to those in the first exemplary embodiment illustrated in FIG. 3, detailed descriptions thereof will not be repeated.

Driving System Schematic View

Figure 13:
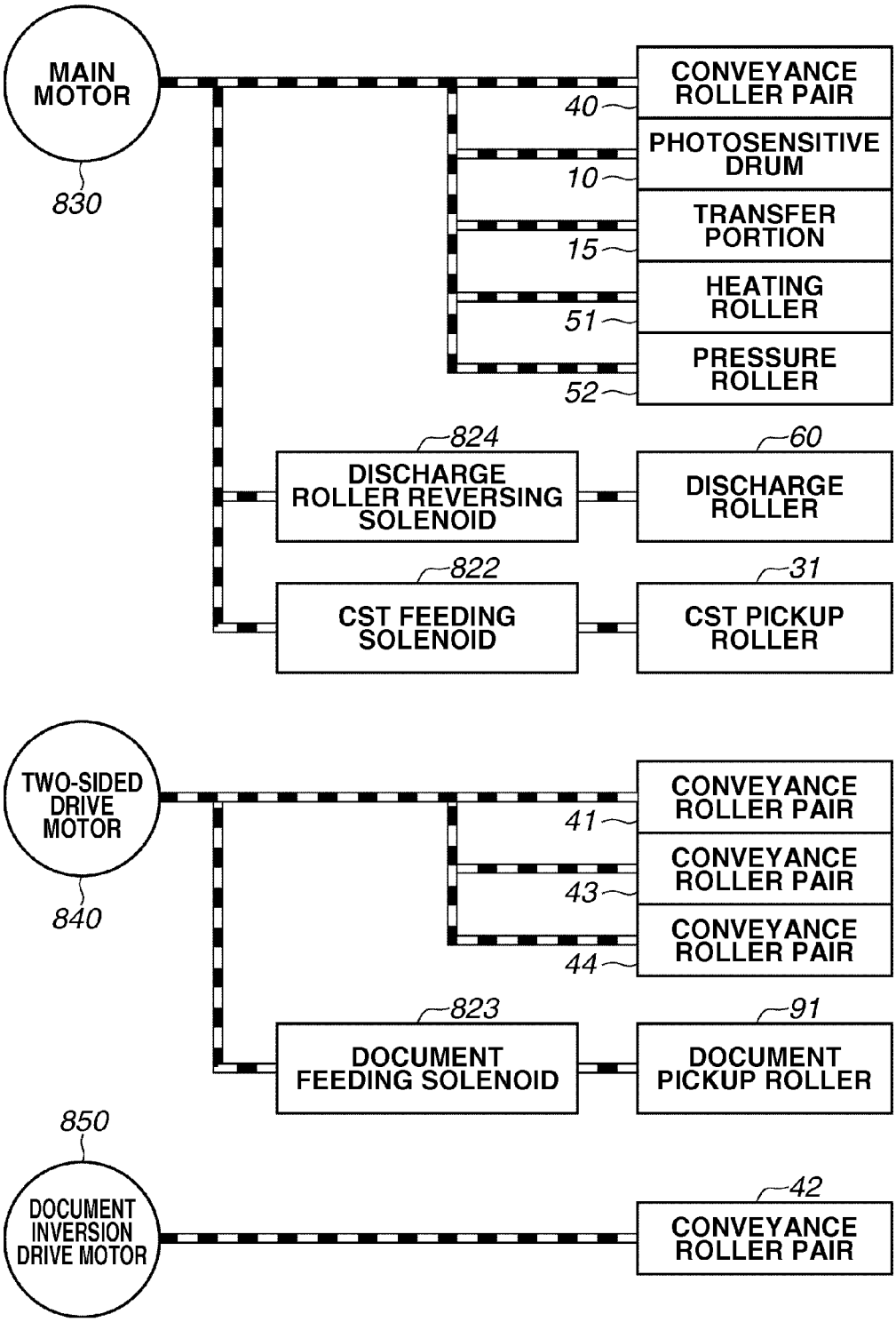
FIG. 13 illustrates driving systems according to the fourth exemplary embodiment.

FIG. 13 is a schematic view illustrating driving systems according to the present exemplary embodiment. As illustrated in FIG. 13, the document inversion drive motor 850 drives only the conveyance roller pair 42. Specifically, unlike the first exemplary embodiment, the present exemplary embodiment is configured to control forward rotation, reverse rotation, and stop of the conveyance roller pair 42 independently of the rotation operation of the conveyance roller pairs 41, 43, and 44, and the document pickup roller 91 which are driven by the two-sided drive motor 840.

Controlling Two-Sided Feeding-Reading of a Plurality of Document Sheets and Continuous Two-Sided Printing on a Plurality of Recording Materials The following describes a process of two-sided reading of image information of a plurality of document sheets G and continuous two-sided printing of the image information on a plurality of recording materials S according to the present exemplary embodiment. Further, the notation of a plurality of document sheets (G1, G2, . . . ,) and a plurality of recording materials (S1, S2, . . . ,) is similar to that in the first exemplary embodiment, and redundant descriptions thereof will not be repeated. The following descriptions will be made on the premise that two-sided feeding-reading for a document sheet G1 has been completed and the document sheet G1 has been discharged onto the second discharge unit 110, and that the conveyance of the recording material S1(0) from the first sheet feed unit 30 has been started.

Figure 14A:
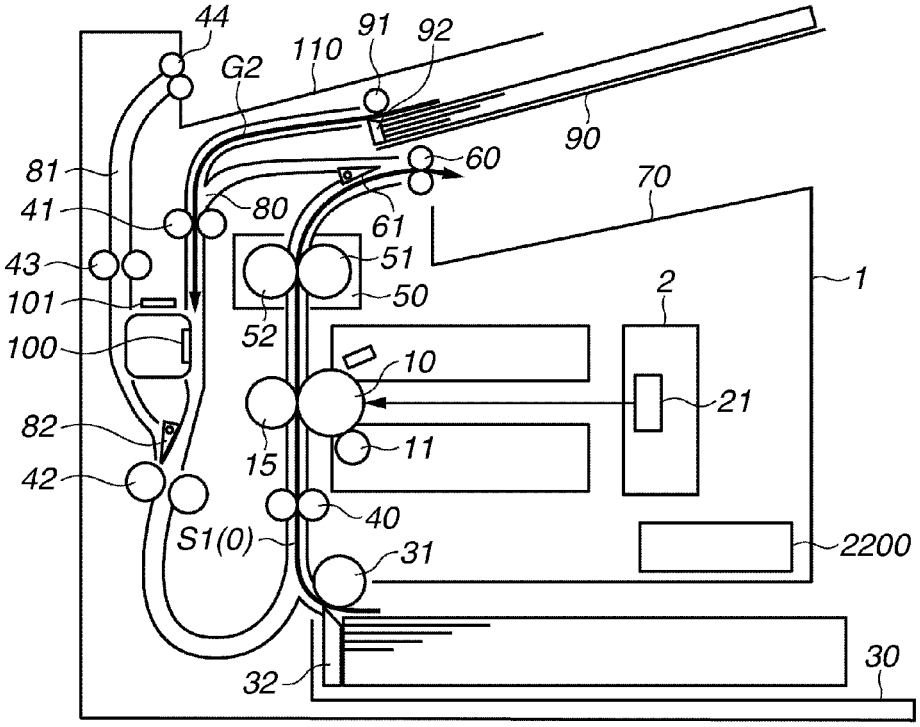
FIGS. 14A and 14B illustrate conveyance operations of a recording material and a document according to the fourth exemplary embodiment.

FIG. 14A illustrates a state where reading of the document sheet G2 is started, and an image forming process for the recording material S1(0). When reading of the second side (back side) of the document sheet G1 has been completed and the document sheet G1 has been discharged onto the second discharge unit 110, the document sheet G2 is conveyed from the second sheet feed unit 90 to the common conveyance path 80. Further, to read image information of the first side (front side) of the document sheet G2, the document reading unit 100 rotates to face the side of the common conveyance path 80. When the image information of the second side (back side) of the document sheet G1 has been printed on the recording material S1(0), the recording material S1(0) is conveyed to the first discharge unit 70 by the discharge roller pair 60. Since image formation on one side of the recording material S1(0) has been completed, the recording material is hereinafter referred to as S1(1).

Figure 14B:
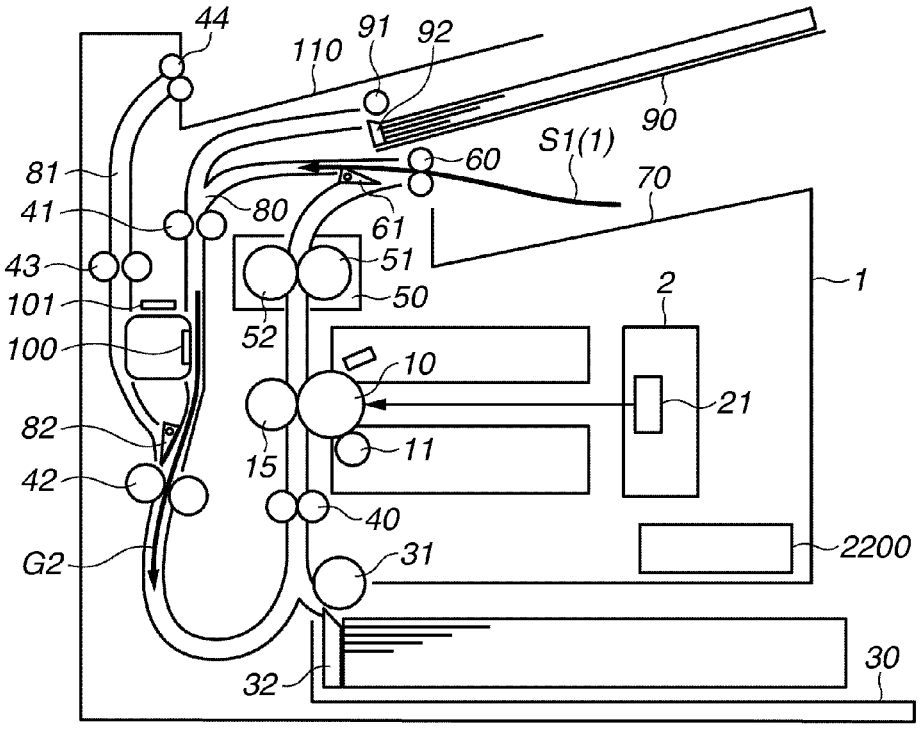

FIG. 14B illustrates a reading process for the first side (front side) of the document sheet G2, and a conveyance operation for the recording material S1(1). While the document sheet G2 is passing the document reading unit 100, the document reading unit 100 reads image information on the first side (front side) of the document sheet G2, and the image information is stored in the image memory 804. Further, the conveyance roller pair 42 independently driven by the document inversion drive motor 850 conveys the document sheet G2. When the trailing edge of the document sheet G2 has passed the switchback flapper 82, the conveyance roller pair 42 stops while the conveyance roller pair 42 pinches the document sheet G2. After a predetermined time has elapsed, the switchback flapper 82 changes the conveyance path from the common conveyance path 80 to the document conveyance path 81. At the same time, the document reading unit 100 rotates to face the document conveyance path 81. Then, the conveyance roller pair 42 rotates in the reverse direction to convey the document sheet G2 to the document conveyance path 81. In the meantime, the discharge roller pair 60 rotates in the reverse direction to convey the recording material S1(1) to the common conveyance path 80.

Figure 14C:
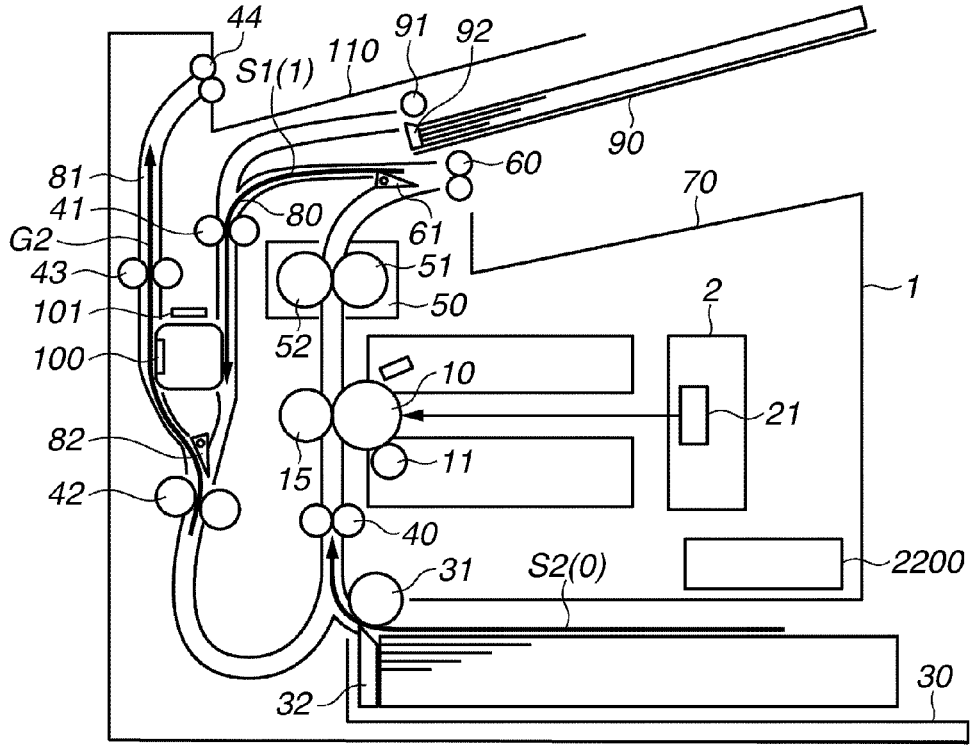
FIGS. 14C and 14D illustrate conveyance operations of a recording material and a document according to the fourth exemplary embodiment.

FIG. 14C illustrates a reading process for the second side (back side) of the document sheet G2, and a conveyance operation for the recording materials S1(1) and S2(0). The document sheet G2 is conveyed to the document conveyance path 81 by the conveyance roller pairs 42 and 43. During conveyance, the document reading unit 100 reads image information of the second side (back side) of the document sheet G2, and the image information is stored in the image memory 804. When reading of the image information of the document sheet G2 has been completed and the trailing edge of the document sheet G2 has passed the conveyance roller pair 42, the conveyance roller pair 42 starts rotating in the reverse direction to convey the recording material S1(1) to the conveyance roller pair 40. In the present exemplary embodiment, such conveyance control is enabled since the conveyance roller pair 41 is driven by the two-sided drive motor 840, and the conveyance roller pair 42 is driven by the document inversion drive motor 850. The recording material S1(1) is conveyed by the discharge roller pair 60, the conveyance roller pair 41, and the conveyance roller pair 42, and passes through the common conveyance path 80. The recording material S2(0) is conveyed from the first sheet feed unit 30 toward the transfer portion 15 to prepare for image formation for the second side (back side) of the document sheet G2.

Figure 14D:
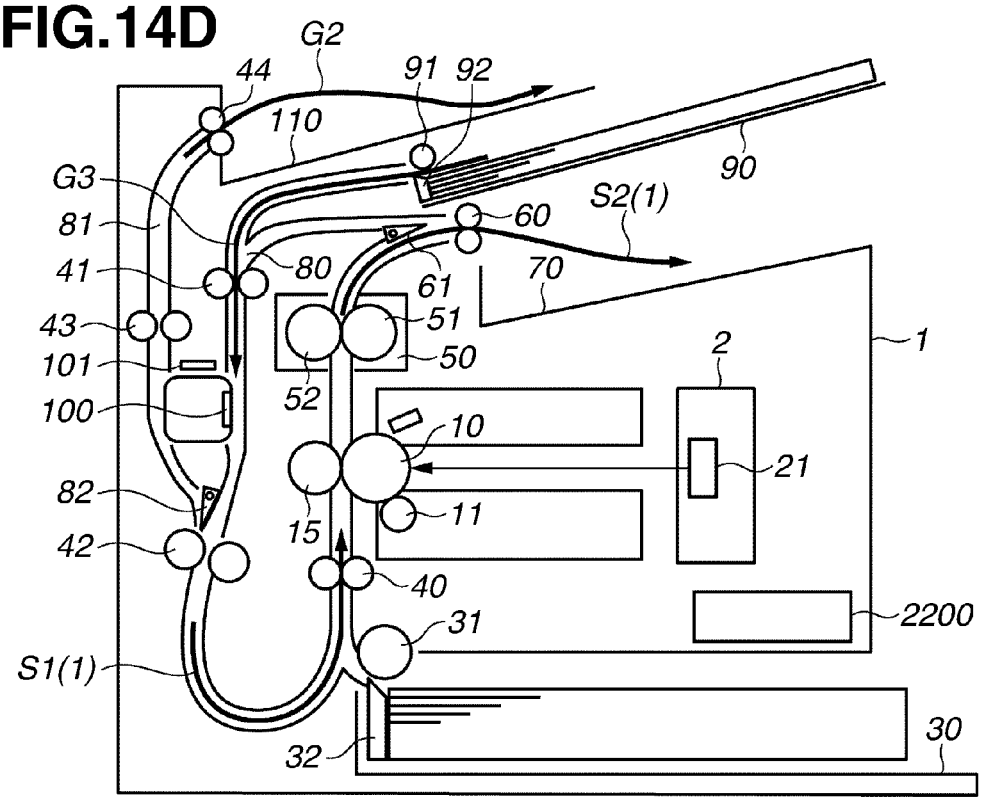

FIG. 14D illustrates a state where the document sheet G2 is discharged and reading of a document sheet G3 is started, and a conveyance operation for the recording materials S1(1) and S2(1). When reading of the document sheet G2 has been completed, the document sheet G2 is discharged onto the second discharge unit 110 by the conveyance roller pair 44. The recording material S1(1) passes through the common conveyance path 80, and is conveyed toward the transfer portion 15 to prepare for image formation for the first side (front side) of the document sheet G1. When image information of the second side (back side) of the document sheet G2 has been printed on the recording material S2(1), the recording material S2(1) is conveyed toward the common conveyance path 80 by the discharge roller pair 60. With the conveyance start time adjusted based on the reading completion time of the document sheet G2 and the conveyance position of the recording material S2(0), the document sheet G3 is conveyed from the second sheet feed unit 90 to the common conveyance path 80.

Figure 14E:
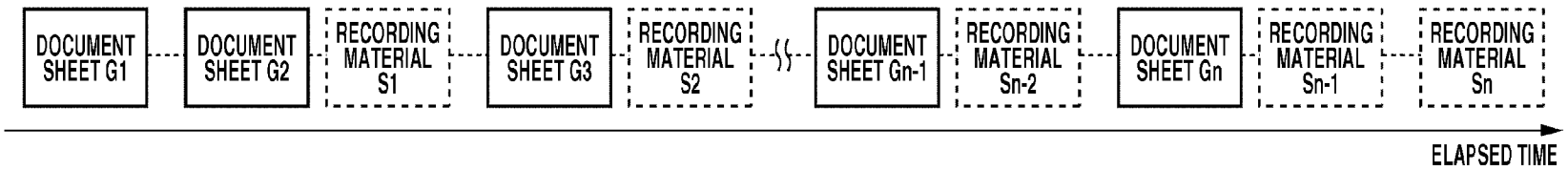
FIG. 14E illustrates the order of conveyance of document sheets and recording materials to a common conveyance path according to the fourth exemplary embodiment.

Order of Conveyance of Document Sheets and Recording Materials to Common Conveyance Path Repetitively performing a process similar to the series of operations described with reference to FIGS. 14A to 14D enables continuous performance of the subsequent printing processes for the recording materials S and the subsequent reading processes for the document sheets G. FIG. 14E illustrates the order of conveyance of the document sheet G and the recording material S to the common conveyance path 80 according to the present exemplary embodiment. According to the above-described process, the order of conveyance of document sheets G and recording materials S to the common conveyance path 80 in a process of two-sided feeding-reading of n document sheets and two-sided printing on n recording materials is as follows. Specifically, the document sheets G and the recording materials S can be continuously conveyed in order of the document sheet G1, the document sheet G2, the recording material S1, the document sheet G3, the recording material S2, . . . , the document sheet Gn-1, the recording material Sn-2, the document sheet Gn, the recording material Sn-1, and the recording material Sn. In other words, reading of the document sheet G and image formation on the recording material S can be performed while the document sheets G and the recording materials S are alternately conveyed to the common conveyance path 80, regardless of the number of document sheets G and the number of recording materials S. The present exemplary embodiment differs from the first exemplary embodiment in that a motor for driving the conveyance roller pair 42 is separately required and that the image memory 804 needs to have a memory capacity for storing image information for four sides which are equivalent to both sides of two document sheets G. However, the present exemplary embodiment enables improvement of the productivity of image formation onto the recording materials S to a further extent than the first exemplary embodiment.

According to the present exemplary embodiment, the image forming apparatus 1 includes the document inversion drive motor 850 as a drive source for the conveyance roller pair 42 so that the conveyance roller pair 42 can change the rotational direction and stop rotation independently of other conveyance roller pairs. On the other hand, as with the first exemplary embodiment, the conveyance roller pair 42 may be driven, like the conveyance roller pairs 41, 43, and 44, by the two-sided drive motor 840. In addition, forward rotation, reverse rotation, and stop of the conveyance roller pair 42 may be separately controlled by a solenoid.

Controlling Document and Recording Material Conveyance Speeds

Similar to the first exemplary embodiment, the document sheet G is conveyed at the conveyance speed Vs, and the recording material S is conveyed at the conveyance speed Vp. How the CPU 801 determines the conveyance speeds Vs and Vp is similar to that in the first or second exemplary embodiment, and detailed descriptions thereof will not be repeated. Also in the present exemplary embodiment, control needs to be performed with the conveyance speeds Vs and Vp set to the common conveyance speed Vc because of a similar reason to that in the first exemplary embodiment. Similar to the first exemplary embodiment, the common conveyance speed Vc is controlled to be equal to or lower than the optimum document conveyance speed Vs' or the optimum recording material conveyance speed Vp', whichever is lower. Similar to the first exemplary embodiment, control may be performed to set the conveyance speeds Vs and Vp to the common conveyance speed Vc or below while the speed difference between the conveyance speeds Vs and Vp is set within a predetermined range including fluctuations in speed of the drive sources or errors in the mechanical structure.

According to the configuration of the present exemplary embodiment, speed control is performed to set the conveyance speeds Vs and Vp to the common conveyance speed Vc, or to set the speed difference between the conveyance speeds Vs and Vp within a predetermined range while the conveyance speeds Vs and Vp are set to the common conveyance speed Vc or below. This control enables achievement of the above-described process of two-sided reading of image information of a plurality of document sheets G and continuous two-sided printing of the image information on a plurality of recording materials S with an inexpensive apparatus configuration without complicated speed control.

Thus, according to the present exemplary embodiment, it is possible to prevent degradation of the productivity in a case where a document reading operation and a printing operation are performed in parallel with a configuration in which a recording material and a document share a common conveyance path.

Although the above-described exemplary embodiments premise a configuration of a monochrome image forming apparatus, the exemplary embodiments of the present invention are also applicable to a color image forming apparatus. The exemplary embodiments of the present invention is applicable to the color image forming apparatus in which photosensitive drums (image bearing members) for forming images of respective colors (yellow, magenta, cyan, and black) are arranged in a row, and images formed on the respective photosensitive drums are transferred onto a recording material or an intermediate transfer member. The present invention is also applicable to the color image forming apparatus in which images of respective colors are sequentially formed on one image bearing member (photosensitive drum), and a color image formed on an intermediate transfer member is transferred onto a recording material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-205854 filed Sep. 19, 2012, which is hereby incorporated by reference herein in its entirety.

What is claimed is:

1. An image forming apparatus comprising:

a first conveyance path configured to convey a recording material to form an image on the recording material;

an image forming unit configured to form the image on the recording material being conveyed in the first conveyance path;

a second conveyance path configured to reverse the recording material having the image formed thereon by the image forming unit and to convey the recording material to the image forming unit again, a reading unit configured to read an image of a document sheet being conveyed in the second conveyance path;

a control unit configured to control a conveyance speed for each of the recording material and the document sheet in a case when conveying the recording material and the document sheet via the second conveyance path, wherein, when the recording material and the document sheet are continuously conveyed at a predetermined interval via the second conveyance path, and when a first intended conveyance speed for conveying the recording material and a second intended conveyance speed for conveying the document sheet are different, the control unit sets both of a first actual conveyance speed for the recording material and a second actual conveyance speed for the document sheet to be equal to whichever, of the first intended conveyance speed and the second intended conveyance speed, is judged by the control unit to be slower.

2. The image forming apparatus according to claim 1, further comprising:

a first drive source configured to drive a conveyance unit disposed in the first conveyance path; and a second drive source different from the first drive source and configured to drive a conveyance unit disposed in the second conveyance path, wherein the control unit controls the first drive source and the second drive source so that a difference between a document conveyance speed and a recording material conveyance speed falls within a predetermined range.

3. The image forming apparatus according to claim 2, wherein, when an image of one document sheet is to be read and formed on one recording material, the control unit controls the first drive source to convey the recording material at the first conveyance speed, and controls the second drive source to convey the document sheet at the second conveyance speed.

4. The image forming apparatus according to claim 2, wherein, when the recording material is not to be conveyed to the second conveyance path, the control unit controls the first drive source to convey the recording material at the first conveyance speed, and controls the second drive source to convey the document sheet at the second conveyance speed.

5. The image forming apparatus according to claim 1, wherein the intended first conveyance speed is set according to a type of the recording material.

6. The image forming apparatus according to claim 1, wherein the intended second conveyance speed is set according to resolution for reading an image of the document sheet.

7. An image forming apparatus comprising:

an image forming unit configured to form an image on a recording material;

a conveyance path configured to convey the recording material on which the image is formed by the image forming unit and a document sheet;

a reading unit configured to read an image of the document sheet being conveyed in the conveyance path; and a control unit configured to control a conveyance speed of each of the recording material and the document sheet when conveying the recording material and the document sheet via the conveyance path, wherein, when the recording material and the document sheet are continuously conveyed at a predetermined interval via the conveyance path, and when a first intended conveyance speed for conveying the recording material and a second intended conveyance speed for conveying the document sheet are different, the control unit sets both of a first actual conveyance speed for the recording material and a second actual conveyance speed for the document sheet to be equal to whichever, of the first intended conveyance speed and the second intended conveyance speed, is judged by the control unit to be slower.

8. The image forming apparatus according to claim 7, further comprising:

a drive source configured to drive a conveyance unit disposed in the conveyance path, wherein the control unit controls the drive source so that a difference between a document conveyance speed and a recording material conveyance speed falls within a predetermined range.

9. The image forming apparatus according to claim 7, wherein the intended first conveyance speed is set according to a type of the recording material.

10. The image forming apparatus according to claim 7, wherein the intended second conveyance speed is set according to resolution for reading an image of the document sheet.

11. The image forming apparatus according to claim 1, wherein the image forming unit forms the image of the document sheet read by the reading unit on the recording material.

12. The image forming apparatus according to claim 7, wherein the image forming unit forms the image of the document sheet read by the reading unit on the recording material.

* * * * *